US010870295B2

(12) United States Patent
Mori et al.

(10) Patent No.: US 10,870,295 B2
(45) Date of Patent: Dec. 22, 2020

(54) INK RIBBON SUPPORT MECHANISM, AND PRINTER

(71) Applicants: CITIZEN WATCH CO., LTD., Tokyo (JP); CITIZEN SYSTEMS JAPAN CO., LTD., Tokyo (JP)

(72) Inventors: Yasuyuki Mori, Tokyo (JP); Katsutoshi Mukaijima, Tokyo (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/649,647

(22) PCT Filed: Sep. 25, 2018

(86) PCT No.: PCT/JP2018/035453
§ 371 (c)(1),
(2) Date: Mar. 21, 2020

(87) PCT Pub. No.: WO2019/065631
PCT Pub. Date: Apr. 4, 2019

(65) Prior Publication Data

US 2020/0269617 A1 Aug. 27, 2020

(30) Foreign Application Priority Data

Sep. 27, 2017 (JP) ..... 2017-185766

(51) Int. Cl.
*B41J 17/24* (2006.01)
*B41J 2/325* (2006.01)
(Continued)

(52) U.S. Cl.
CPC ..... *B41J 17/24* (2013.01); *B41J 2/325* (2013.01); *B65H 16/06* (2013.01); *B65H 18/06* (2013.01)

(58) Field of Classification Search
CPC ..... B41J 17/24; B41J 2/325; B65H 16/06; B65H 18/06
See application file for complete search history.

(56) References Cited

U.S. PATENT DOCUMENTS 4,883,234 A 11/1989 Noboru
5,727,883 A 3/1998 Yutaka
(Continued)

FOREIGN PATENT DOCUMENTS

JP S61-217276 A 9/1986
JP S63-179136 U 11/1988
(Continued)

OTHER PUBLICATIONS

International Search Report from corresponding International Patent Application No. PCT/JP2018/035453, dated Nov. 13, 2018, 4 pages.

*Primary Examiner* — Bradley W Thies
(74) *Attorney, Agent, or Firm* — Tucker Ellis LLP

(57) ABSTRACT

A printer includes support members having a convex portion and a support hole as two support portions, and a shaft that includes, in both end portions thereof, a concave portion and a projection portion as supported portions engaging with the support members, respectively, and supports an ink ribbon, the convex portion is rotatable, the convex portion is fitted into the concave portion, the convex portion includes a portion having a pentagonal truncated pyramid liked shape extending in an axis direction, the concave portion includes an inner circumference surface having a polygonal liked shape corresponding to the number of corners of the portion having the truncated pyramid liked shape, and includes a coil spring that elastically displaces the shaft in which the concave portion is formed in a withdrawing direction.

8 Claims, 19 Drawing Sheets

(51) Int. Cl.
*B65H 16/06* (2006.01)
*B65H 18/06* (2006.01)

(56) References Cited

U.S. PATENT DOCUMENTS

| | | | | |
|---|---|---|---|---|
| 2003/0047635 | A1 | 3/2003 | Hiraoka | |
| 2007/0243000 | A1* | 10/2007 | Ho | B41J 17/32 400/223 |

FOREIGN PATENT DOCUMENTS

| | | | |
|---|---|---|---|
| JP | H01-064456 | U | 1/1994 |
| JP | H06-79892 | A | 3/1994 |
| JP | H08-52917 | A | 2/1996 |
| JP | H09-277638 | A | 10/1997 |
| JP | 200380783 | A | 3/2003 |
| JP | 2014210388 | A | 11/2014 |

* cited by examiner

INK RIBBON SUPPORT MECHANISM, AND PRINTER

CROSS-REFERENCE TO RELATED APPLICATION

The present application is based on and claims priority to Japanese Patent Application No. 2017-185766, filed on Sep. 27, 2017, the disclosure of which is hereby incorporated by reference in its entirety.

TECHNICAL FIELD

This disclosure relates to an ink ribbon support mechanism and a printer.

BACKGROUND ART

In a printer that transfers ink to a paper with an ink ribbon supported by an ink ribbon support mechanism for printing, the ink ribbon is wound in a roll around a feeding shaft. The printer feeds the ink ribbon at the approximate same speed as the paper by winding the ink ribbon around a winding shaft (hereinafter, winding shaft and feeding shaft are referred to as ribbon shafts). Each of the ribbon shafts includes both end portions to be supported (hereinafter, supported portion). The supported portions engage with two support portions, respectively, provided in a support member to face each other at a predetermined interval, and are supported by the two support portions, respectively.

One of the two support portions is rotatable via, for example, a gear train from a motor. The ribbon shaft whose supported portion engages with the rotating support portion rotates about an axis together with the support portion, so that the ink ribbon is wound around the ribbon shaft. Moreover, the ribbon shaft whose supported portion rotatably engages with the support portion rotates about an axis, so that the ink ribbon is fed from the ribbon shaft.

The support portion includes, for example, a convex portion conically projecting in an axis direction while the supported portion includes, for example, a conical concave portion (space). The convex portion includes a plurality of ribs radially extending along a slope connecting an apex and a bottom surface of the cone while the concave portion includes a plurality of grooves radially extending along a slope connecting an apex and a bottom surface of the cone. When the ribs of the convex portion are fitted into the grooves of the concave portion, the rotation of the support portion is transferred to the supported portion via the ribs of the convex portion and the grooves of the concave portion, so as to rotate the shaft (see, for example, JP2014-210388A).

SUMMARY

In order to engage the concave portion of the shaft with the convex portion of the support portion, it is necessary to adjust the position of the shaft in the rotation direction such that the ribs of the convex portion are aligned with the grooves of the concave portion. A user, therefore, positions the grooves of the concave portion in the ribs of the convex portions while checking the positions of the ribs of the convex portion and the positions of the grooves of the concave portion, so as to attach the shaft to the support member.

However, when a user engages the concave portion with the convex portion without checking the positional relationship between the ribs of the convex portion and the grooves of the concave portion, the rib of the convex portion may be positioned in a relatively projecting portion between the two grooves of the concave portion. With this positioning, when the concave portion is engaged with the convex portion, the rib of the convex portion contacts the projecting portion, and the shaft cannot be supported by the support member.

The present disclosure has been made in view of the above circumstances, and an object of the present disclosure is to provide an ink ribbon support mechanism in which the ribbon shaft can be supported by a printer body by appropriately fitting the convex portion into the concave portion without making a user conscious of an angular positional relationship of the concave portion and the convex portion about an axis.

A first aspect of the present disclosure provides an ink ribbon support mechanism including one support member or a plurality of support members and a ribbon shaft that supports an ink ribbon. Two support portions are provided in the one support member or each of the plurality of the support members to face each other, or the one support portion is provided in each of the plurality of support members to face each other. The ribbon shaft includes, in both end portions thereof, supported portions that engage with the two support portions, respectively. One of the two support portions is rotatable. One of the rotatable support portion and the supported portion that engages with the rotatable support portion includes a convex portion projecting from an end surface, and another of the rotatable support portion and the supported portion that engages with the rotatable support portion includes a concave portion that is recessed from the end surface and engages with the convex portion. The convex portion includes a portion having any one of pentagonal to octagonal truncated pyramid liked shapes extending in an axis direction. The concave portion has a polygonal liked shape corresponding to the number of corners of the portion having the truncated pyramid liked shape. At least one of the rotatable support portion and the ribbon shaft includes an elastic member that elastically displaces at least one part of the two support portions and the two supported portions in a withdrawing direction.

A second aspect of the present disclosure provides a printer including the ink ribbon mechanism according to the present disclosure.

DESCRIPTION OF EMBODIMENT

Hereinafter, an embodiment of an ink ribbon support mechanism and a printer including the same according to the present disclosure are described with reference to the drawings.

Figure 1:
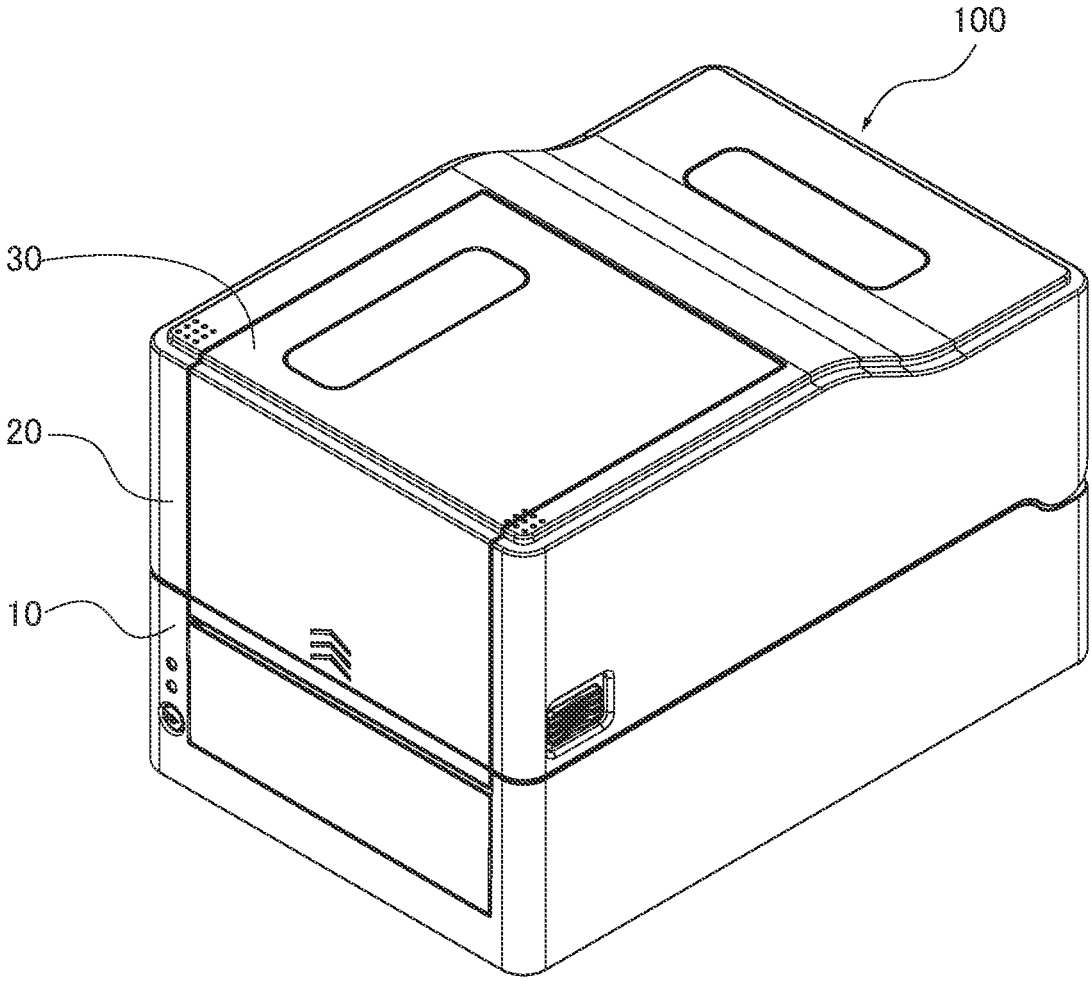
FIG. 1 is a perspective view illustrating a thermal printer (with cover closed) which is an embodiment of a printer including an ink ribbon support mechanism according to the present disclosure.
Figure 2:
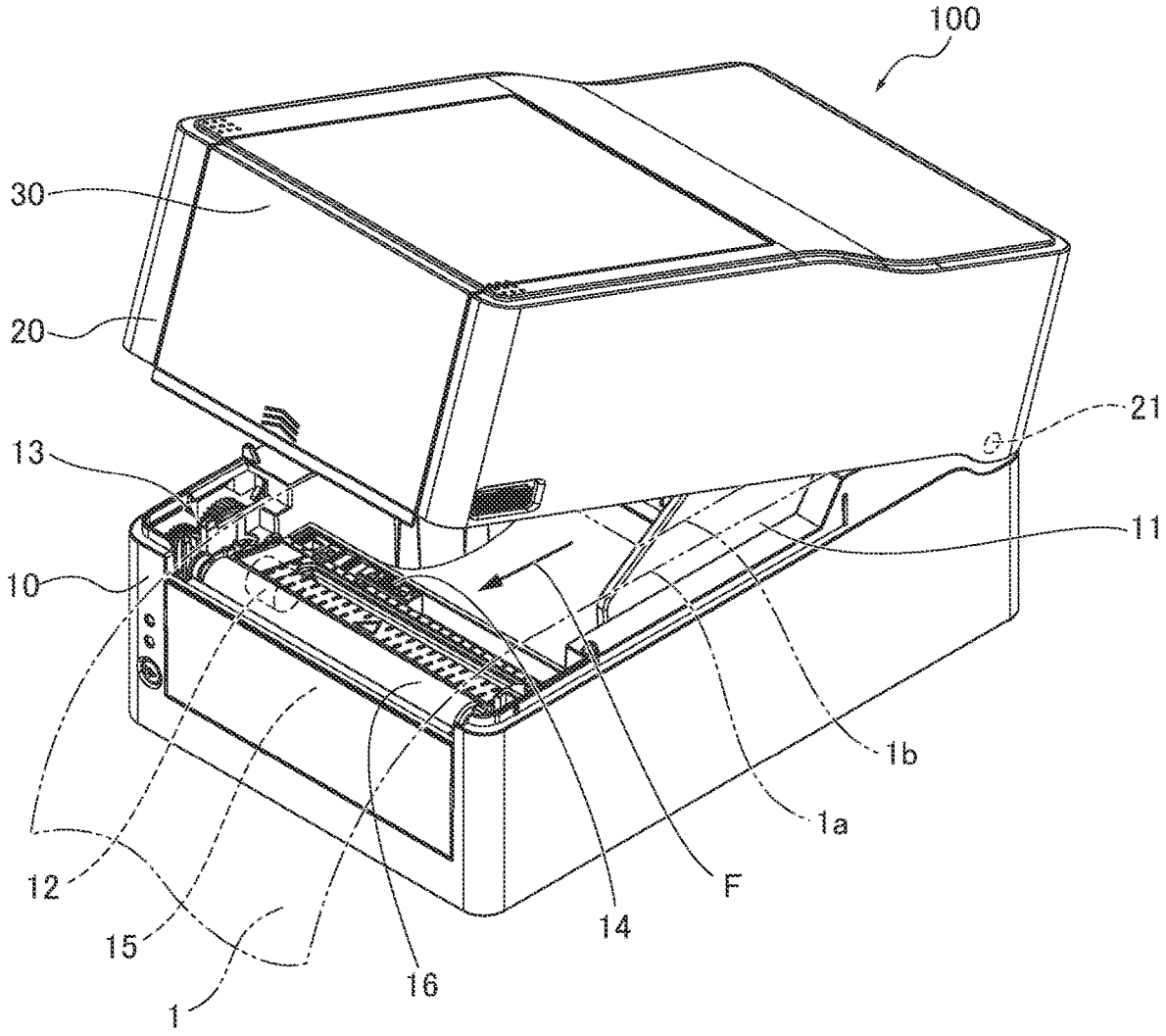
FIG. 2 is a perspective view illustrating the printer of FIG. 1 when the cover is open.
Figure 3:
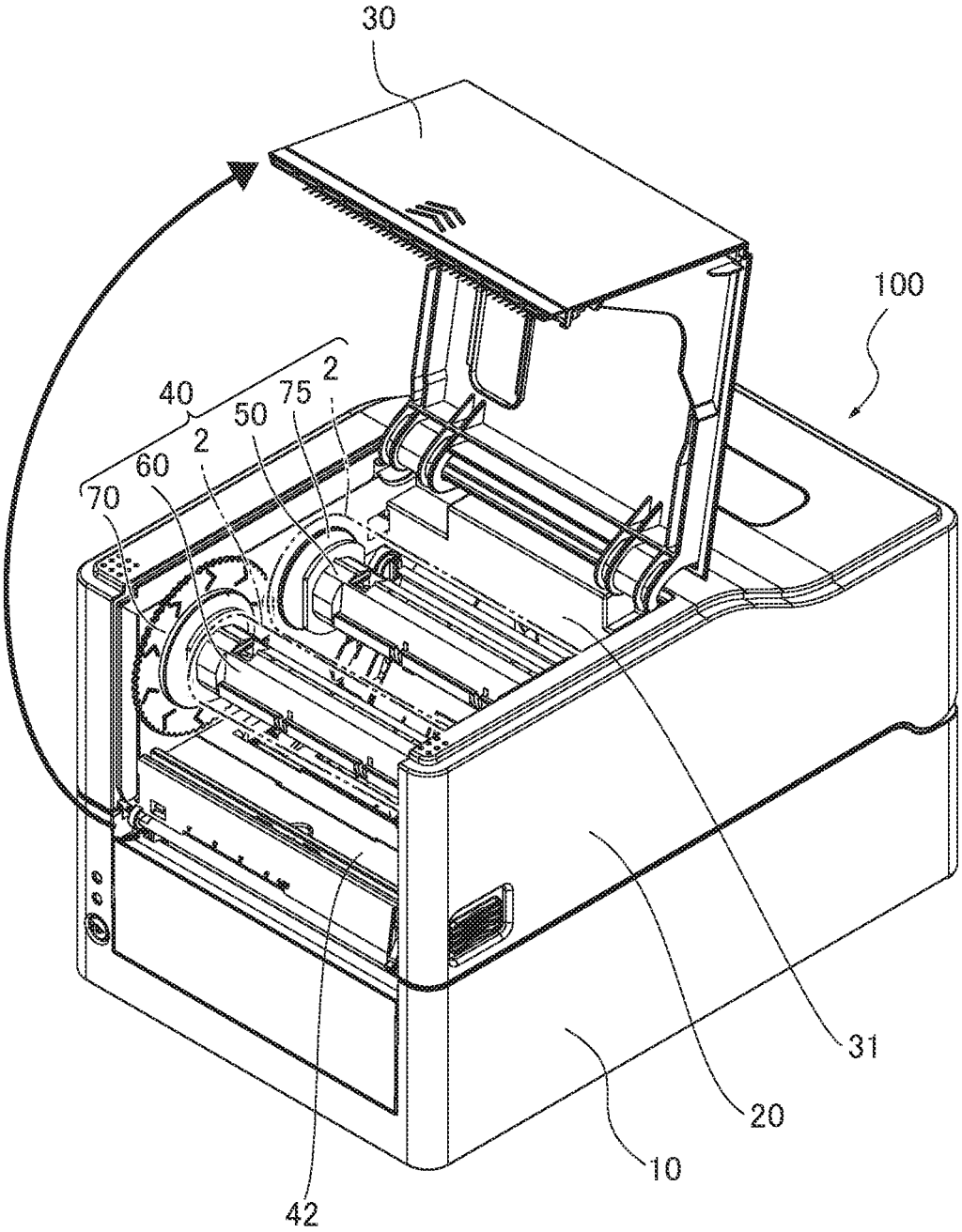
FIG. 3 is a perspective view illustrating the thermal printer of FIG. 1 when a top cover is open.
Figure 4:
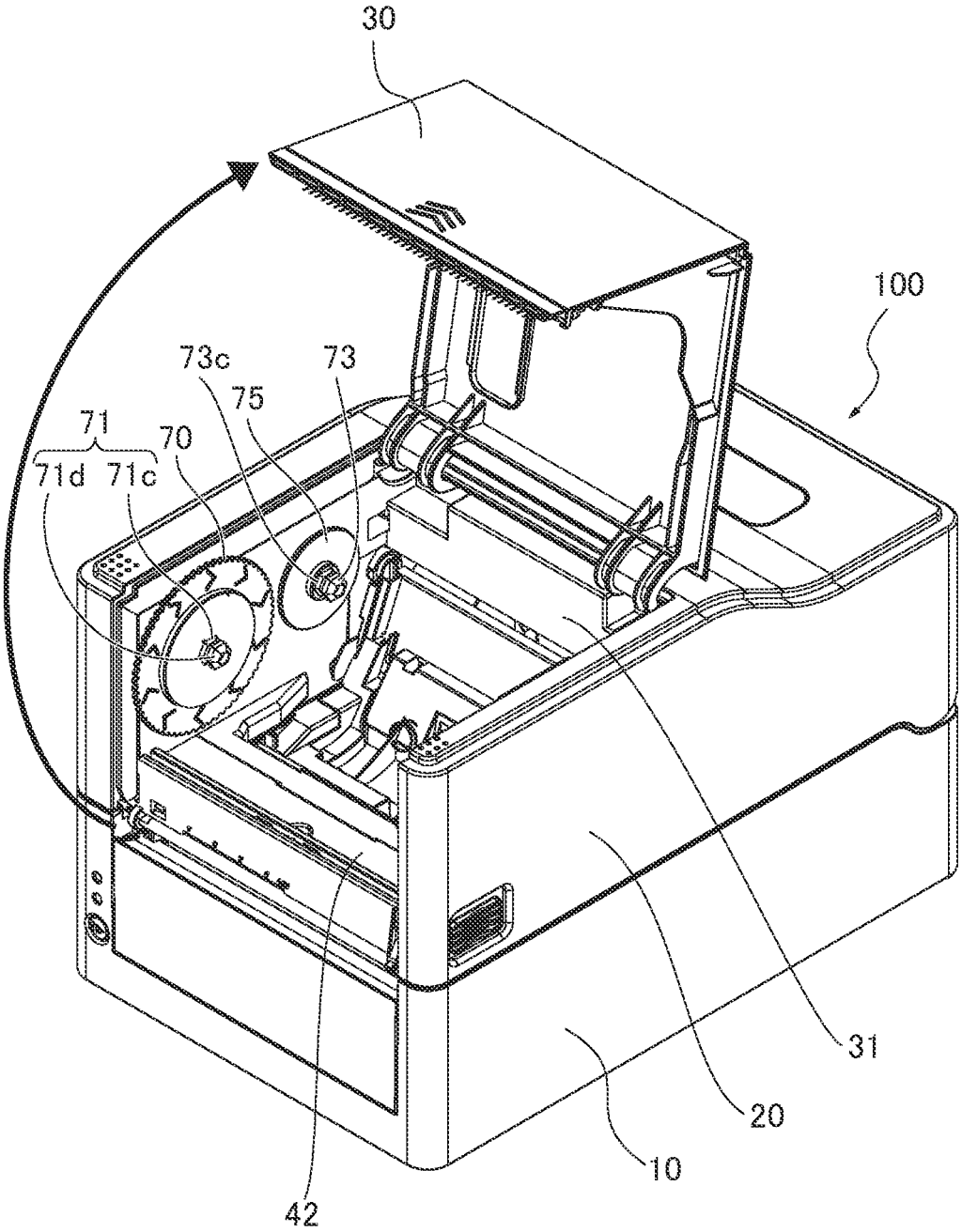
FIG. 4 is a perspective view illustrating the thermal printer of FIG. 3 from which a winding shaft (one example of a ribbon shaft) and a feeding shaft (one example of the ribbon shaft) are removed.

(Configuration of Thermal Printer) FIG. 1 is a perspective view illustrating a thermal printer 100 (hereinafter referred to as a printer 100 when a cover 20 is closed) including an ink ribbon support mechanism according to the present disclosure. FIG. 2 is a perspective view illustrating the printer 100 when the cover 20 is open. FIG. 3 is a perspective view illustrating the printer 100 when a top cover 30 is open. FIG. 4 is a perspective view illustrating the printer of FIG. 3 from which a winding shaft 60 (one example of a ribbon shaft) and a feeding shaft 50 (one example of the ribbon shaft) are removed.

As illustrated in FIG. 1, the printer 100 includes a body 10 and a cover 20. The cover 20 is rotatably supported by the body 10. Specifically, a rear portion of the cover 20 in the vicinity of the bottom end of the cover 20 is supported by a rear portion of the body 10 in the vicinity of the upper end of the body 10. As illustrated in FIG. 2, the cover 20 therefore rotates upward and rearward relative to the body 10 at a supported portion 21.

The body 10 includes a paper storage portion 11. The paper storage portion 11 is exposed when the cover 20 is open. The paper storage portion 11 houses a label paper 1 in a roll, for example. In addition to the paper storage portion 11, the body 10 includes a motor 12, a gear train 13, a paper sensor 14, a control portion 15, and a platen roller 16.

The motor 12 is driven under the control of the control portion 15 to rotate the gear train 13. The gear train 13 rotates the platen roller 16 to move the label paper 1 contacting the platen roller 16 forward F. When the cover 20 is closed, the gear train 13 engages with an after-described gear train 90 in the cover 20 to rotate the winding shaft 60 of the ink ribbon 2 connected to the gear train 90.

The paper sensor 14 detects a label 1*b* attached to a mount 1*a* of the label paper 1. The control portion 15 controls the driving of the motor 12 based on the detection result of the paper sensor 14, and also controls a thermal print head 42, so as to appropriately print on the label 1*b* on the platen roller 16.

Figure 5:
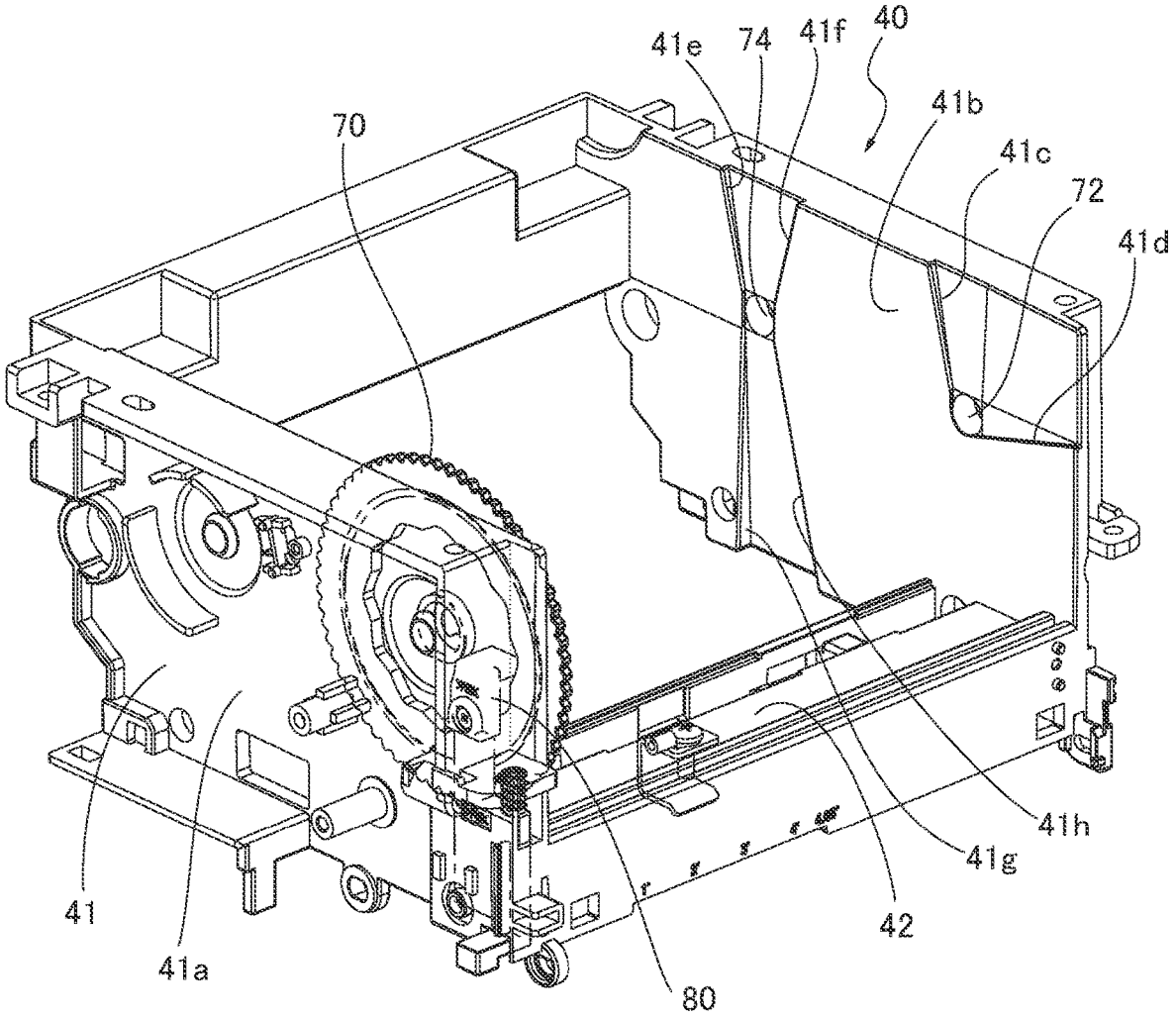
FIG. 5 is a perspective view illustrating a part of a printing portion.
Figure 6:
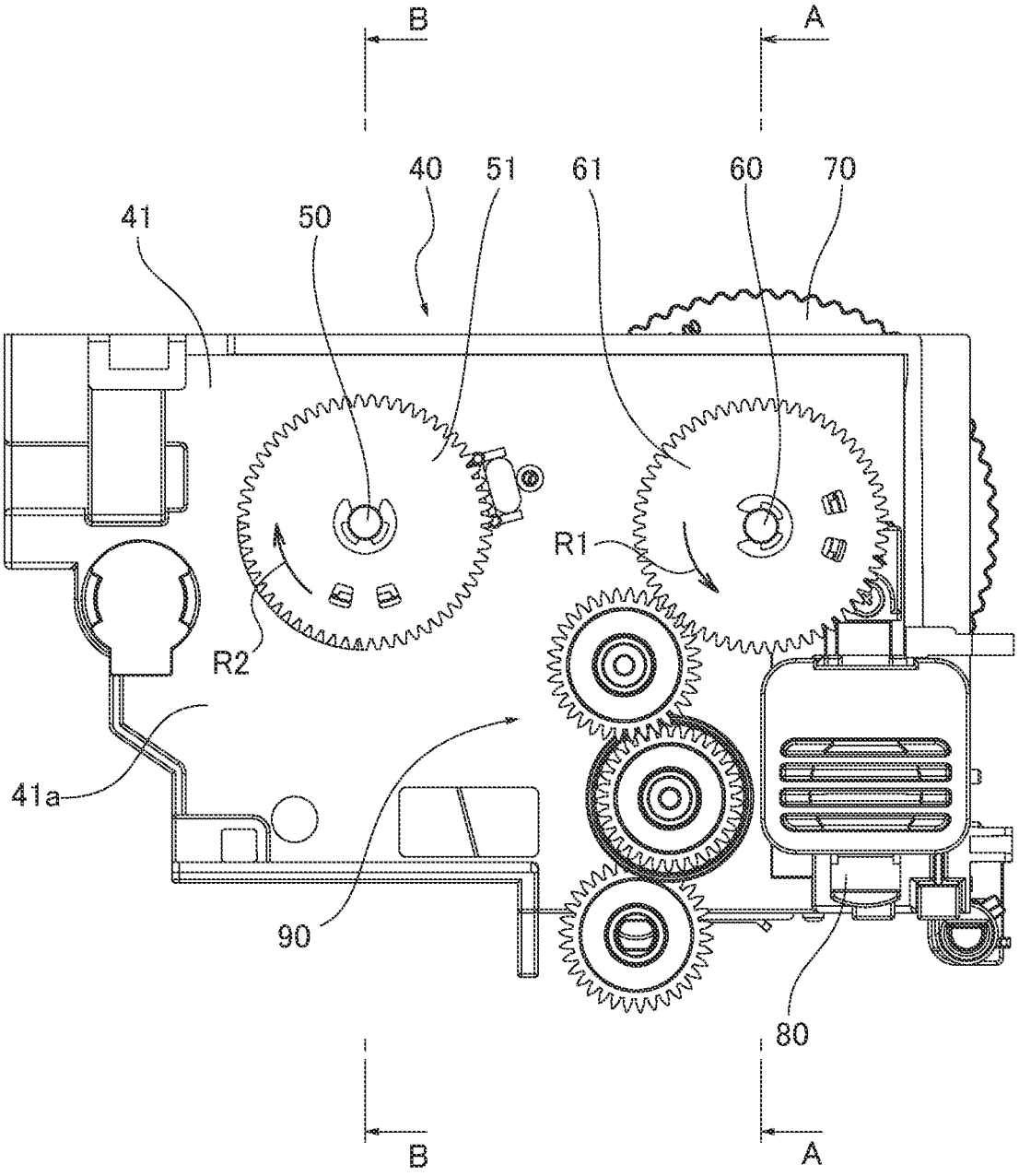
FIG. 6 is a side view illustrating one side of the printing portion.
Figure 7:
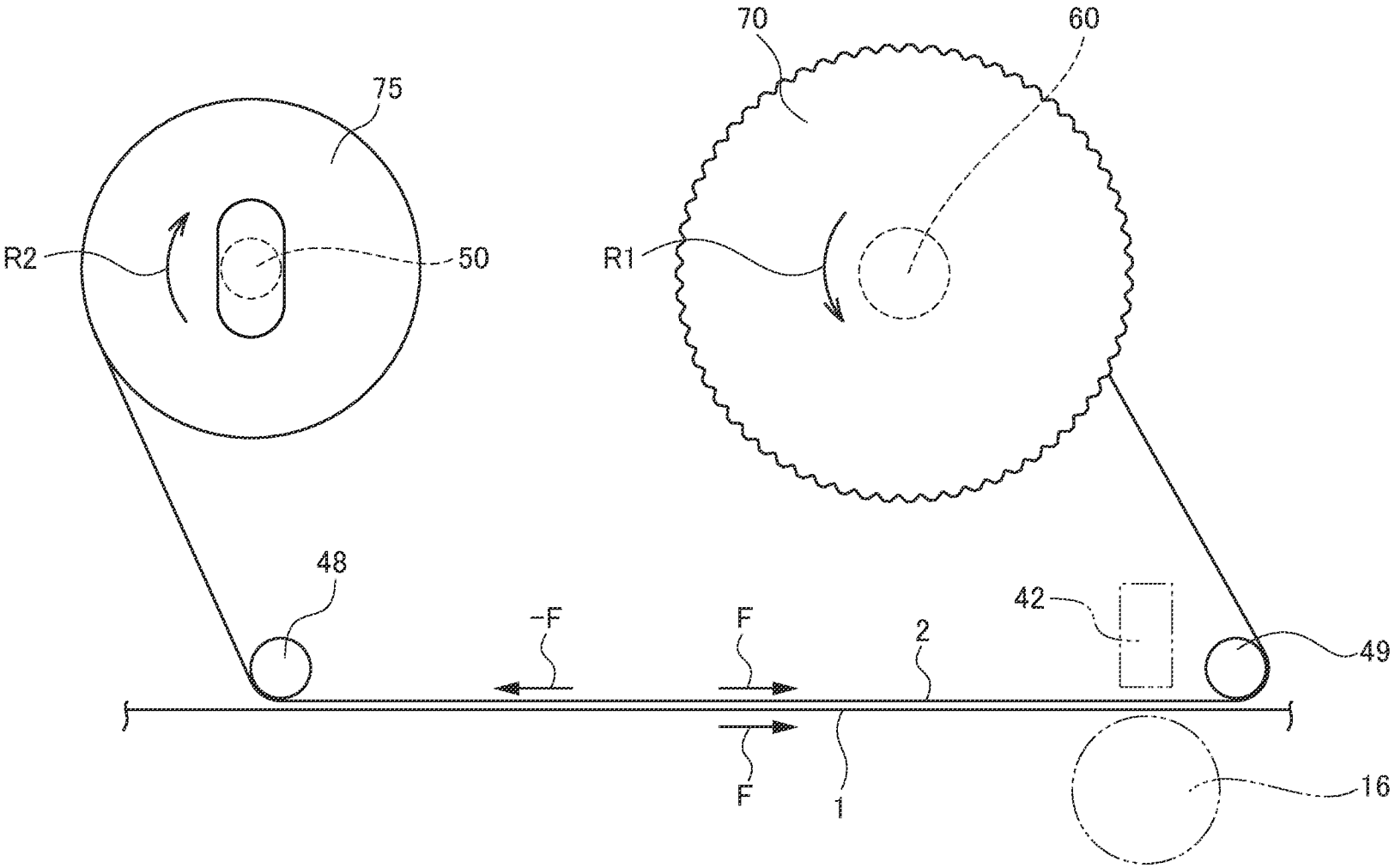
FIG. 7 is a schematic view illustrating an arrangement of an ink ribbon in the printing portion.

As illustrated in FIG. 3, an ink ribbon storage portion 31 of the cover 20 houses a printing portion 40. FIG. 5 is a perspective view illustrating a part of the printing portion 40. FIG. 6 is a side view illustrating one side of the printing portion 40. FIG. 7 is a schematic view illustrating the arrangement of the ink ribbon 2 in the printing portion 40.

As illustrated in FIGS. 3 to 6, the printing portion 40 includes the ink ribbon 2, the thermal print head 42, the feeding shaft 50 for the ink ribbon 2, the winding shaft 60 for the ink ribbon 2, a ribbon flange 70, the gear train 90, a ribbon guide member 48 and a guide shaft 49 for guiding the ink ribbon 2, and a regulation member or lock member 80. These elements are supported by a support member 41 which has a box shape.

As illustrated in FIG. 7, the thermal print head 42 is located above the platen roller 16 when the cover 20 is closed and is controlled by the control portion 15. The unused portion of the ink ribbon 2 is wound in a roll around the feeding shaft 50 and the used portion of the ink ribbon 2 is wound in a roll around the winding shaft 60. In other words, the ink ribbon 2 is wound around the winding shaft 60 from the feeding shaft 50 in use. The ribbon guide member 48 and the guide shaft 49 are arranged on the path for the ink ribbon 2 between the feeding shaft 50 and the winding shaft 60. The thermal print head 42 and the ink ribbon 2 are thereby located between the ribbon guide member 48 and the guide shaft 49 when the cover 20 is closed.

As illustrated in FIG. 7, the ink ribbon 2 is wound around the winding shaft 60 from the feeding shaft 50 via the ribbon guide member 48 and the guide shaft 49. The ink ribbon 2 overlaps the label paper 1 between the thermal print head 42 and the platen roller 16 and is moved forward F on the path between the ribbon guide member 48 and the guide shaft 49 at the same speed as the label paper 1 or a speed slightly faster than the label paper 1.

The feeding shaft 50 and the winding shaft 60 are disposed in the width direction between side walls 41*a*, 41*b* of the support member 41. The gear train 90 is disposed outside the side wall 41*a*. The gear train 90 transfers a rotation driving force to the winding shaft 60 via a clutch mechanism 61 and the ribbon flange 70. The gear train 90 engages with the gear train 13 in the body 10 when the cover 20 is closed.

Accordingly, the winding shaft 60 is connected to the motor 12 when the cover 20 is closed but is disconnected from the motor 12 when the cover 20 is open. With the cover 20 closed, the motor 12 rotates the winding shaft 60 in a direction for winding the ink ribbon (i.e., a counterclockwise direction in FIG. 5; also referred to as a winding direction R1) via the gear train 13 in the body 10 and the gear train 90 in the cover 20 so that the ink ribbon 2 is wound around the winding shaft 60. When the motor 12 is stopped and the cover 20 is closed, the braking force of the motor 12 holds the winding shaft 60 unmoved.

On the other hand, when the cover 20 is open, the braking force of the motor 12 does not act on the winding shaft 60 since the winding shaft 60 is disconnected from the motor 12, but regulates the winding shaft 60 from rotating in the clockwise direction R2 with the co-operation of the lock member 80 and a not-shown cam portion formed in the ribbon flange 70. The detailed description for the regulation mechanism is omitted. The ribbon flange 70 and the lock member 80 do not regulate the winding shaft 60 from rotating in the counterclockwise direction R1.

A clutch mechanism 51 is connected to the feeding shaft 50. The clutch mechanism 51 includes a torsion spring that applies torque in the direction R2 (the clockwise direction) opposite to the winding direction R1 of the ink ribbon 2 wound around the winding shaft 60. The clutch mechanism 51 is disposed outside the side wall 41*a*. A ribbon flange 75 connected to the clutch mechanism 51 is disposed inside the side wall 41*a*. The ribbon flange 75 is provided with a not-shown encoder sheet that detects a rotation state. The ribbon flange 75 may be provided for a different purpose, for example, as a guide for manually winding the unwound ink ribbon 2 when a part of the ink ribbon 2 wound around the feeding shaft 50 is unwound into a sheet.

A clutch mechanism 61 connected to the winding shaft 60 absorbs the difference between the angular speed of the gear train 90 and the angular speed of the shaft 60 when the shaft 60 rotates. The clutch mechanism 61 is disposed outside the side wall 41*a*. A ribbon flange 70 connected to the clutch mechanism 61 is provided inside the side wall 41*a*. The ribbon flange 70 includes, in an outer circumference portion thereof, an irregularity, and is used for preventing the ink ribbon 2 from loosening by manually rotating the winding shaft 60. The ribbon flange 70 may be provided for preventing the ink ribbon 2 wound around the shaft 60 from concentrating on one side in an axis center C direction.

Figure 8:
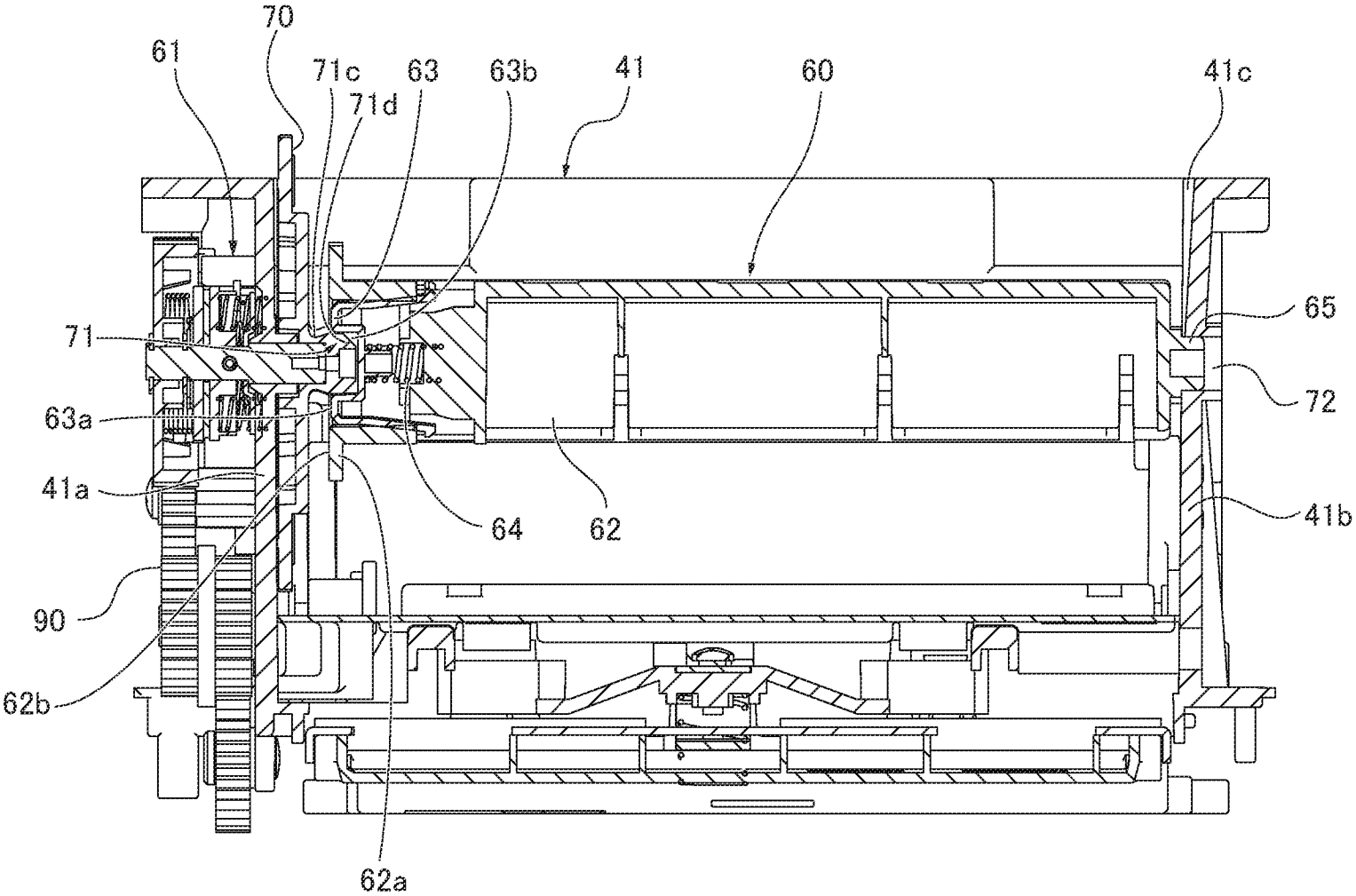
FIG. 8 is a cross-sectional view along an A-A line illustrated in FIG. 6.
Figure 9:
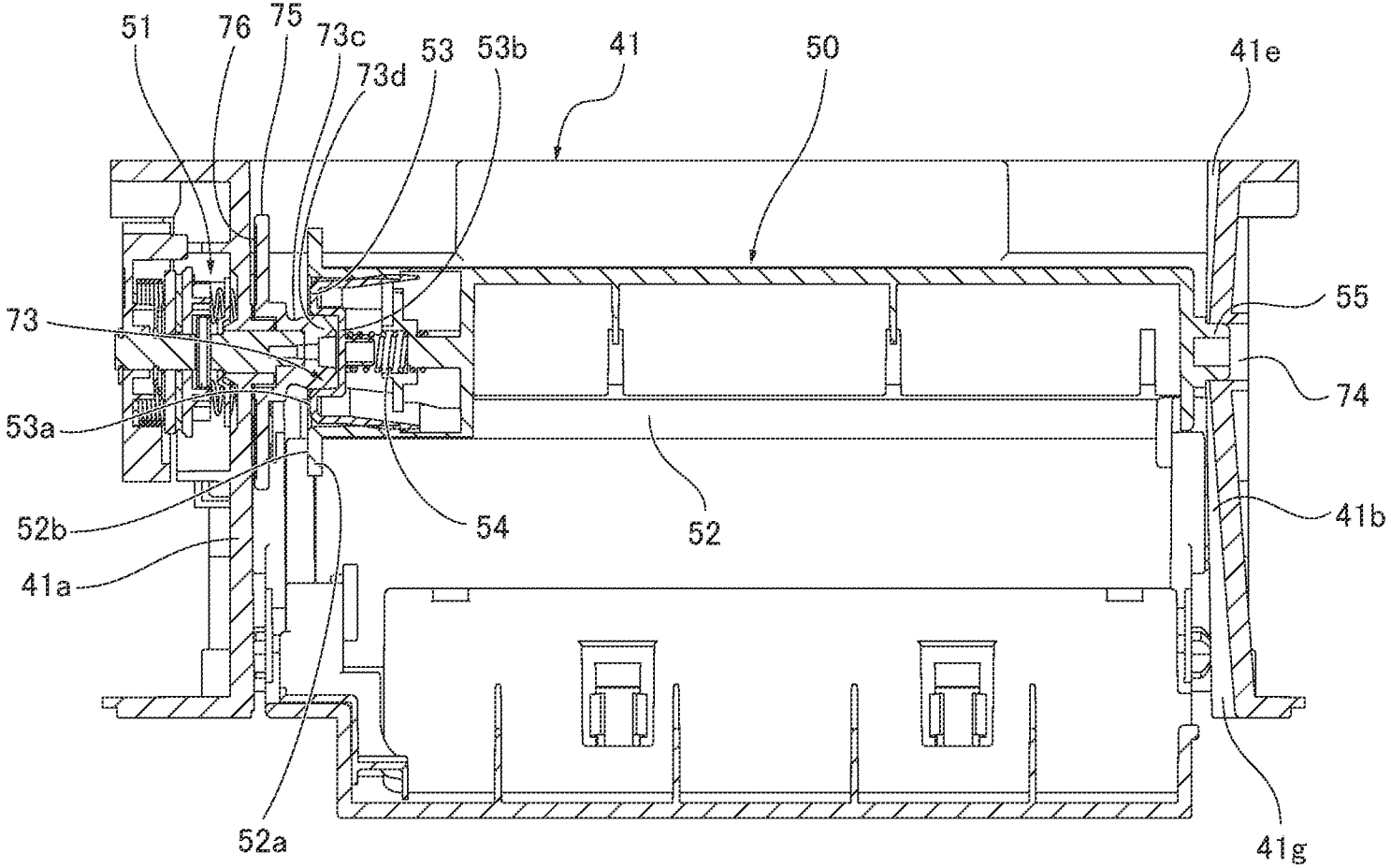
FIG. 9 is a cross-sectional view along a B-B line illustrated in FIG. 6.
Figure 10:
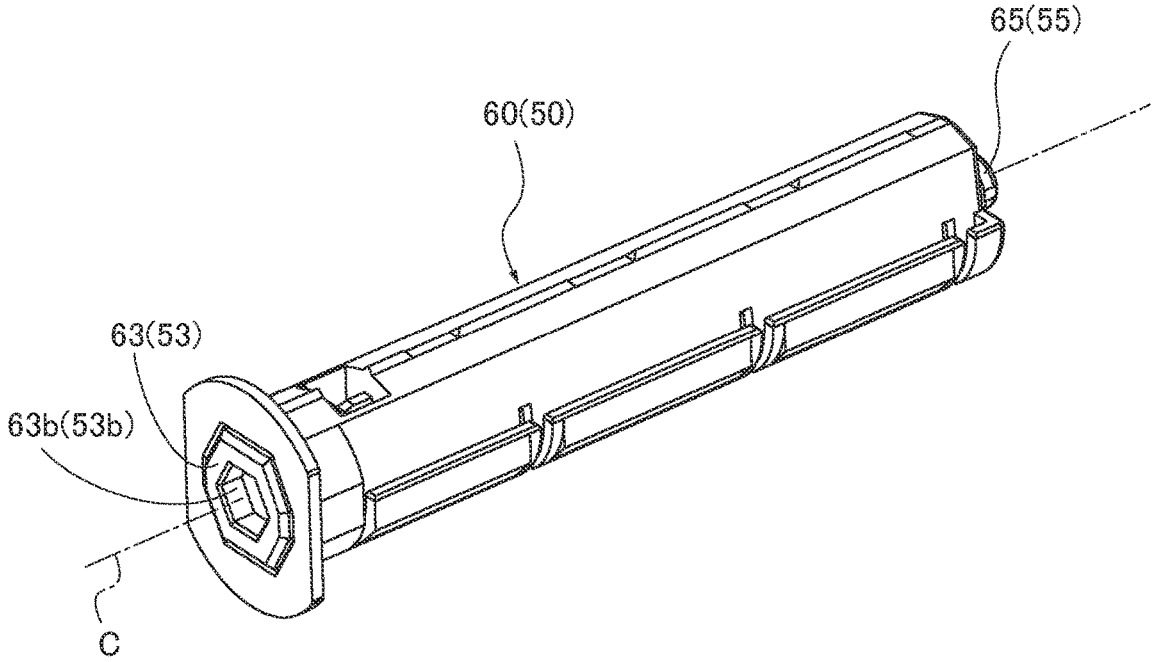
FIG. 10 is a perspective view illustrating the winding shaft and the feeding shaft.
Figure 11:
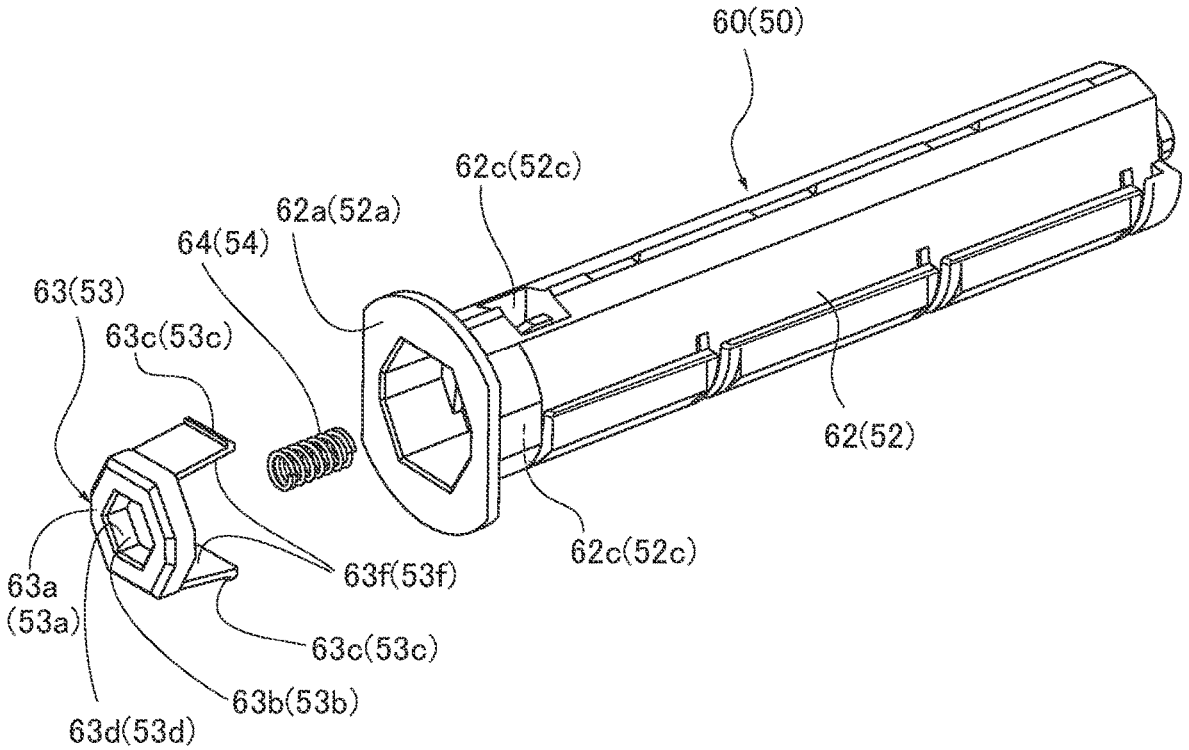
FIG. 11 is an exploded perspective view illustrating the winding shaft and the feeding shaft.
Figure 12:
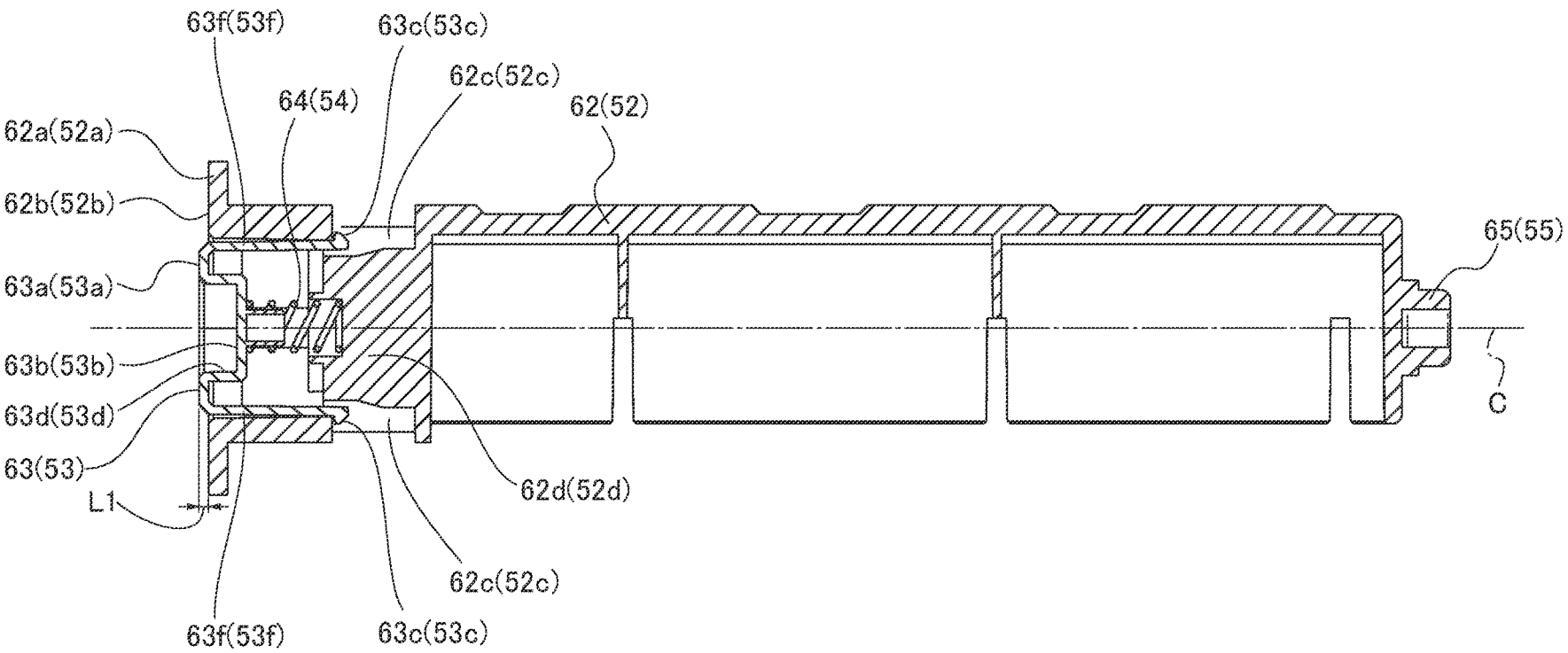
FIG. 12 is a cross-sectional view illustrating a longitudinal cross-section of the winding shaft and the feeding shaft.
Figure 13:
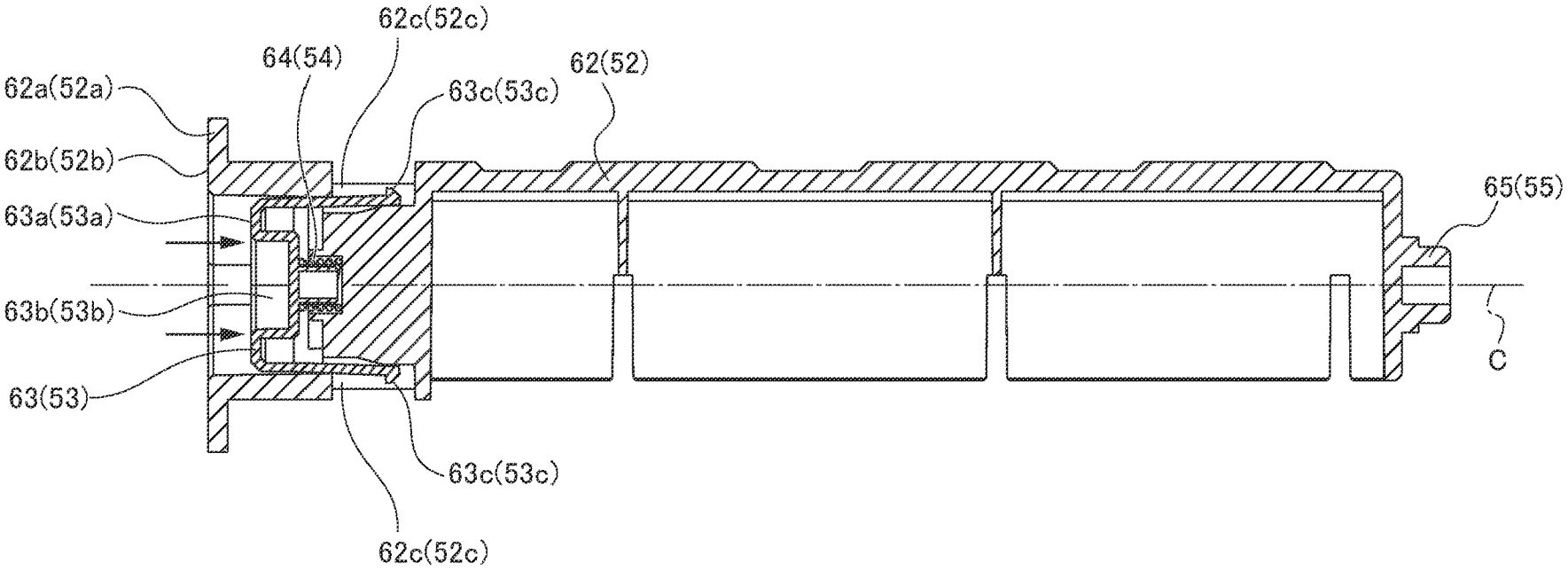
FIG. 13 is a cross-sectional view illustrating a longitudinal cross-section when a coil of the winding shaft and the feeding shaft is compressed.

FIG. 8 is a cross-sectional view illustrating a cross-section including the winding shaft 60 along an A-A line illustrated in FIG. 6. FIG. 9 is a cross-sectional view illustrating a cross-section including the feeding shaft 50 along a B-B line illustrated in FIG. 6. FIG. 10 is a perspective view illustrating the winding shaft 60 and the feeding shaft 50. FIG. 11 is an exploded perspective view illustrating components of the winding shaft 60 and the feeding shaft 50 of FIG. 10. FIG. 12 is a cross-sectional view illustrating a longitudinal cross-section along the axis center C of the winding shaft 60 and the feeding shaft 50. FIG. 13 is a cross-sectional view illustrating an end member 63, 53 of the shaft 60, 50 elastically displaced in the axis center C direction.

As illustrated in FIGS. 10 to 13, the winding shaft 60 includes a body 62, an end member 63, and a coil spring 64. The body 62 is a hollow cylindrical body. The body 62 has an open first end portion (left end portion in figures). A flange 62*a* is formed in the first end portion. A contact portion 62*d* is formed behind the open first end portion. The body 62 has a closed second end portion (right end portion in figures). A projection portion 65 projecting in the axis center C direction is formed in the second end portion to include the axis center C. As illustrated in FIGS. 5, 7, the projection portion 65 rotatably engages with a support hole 72 (one example of a support portion) formed in the support member 41.

Two holes 62*c*, 62*c* are formed in a surrounding wall of the contact portion 62*d* in outside positions in the radial direction. The two holes 62*c* are formed at an interval of 180 degrees about the axis center C, and are long holes, respectively, extending in the axis center C direction.

The end member 63 includes an end surface 63*a* orthogonal to the axis center C, and has an approximate hexagonal external contour. The end member 63 includes leg portions 63*f* that extend in the axis center C direction from external contour edges corresponding to facing two sides of the hexagonal end surface 63*a*. A claw 63*c* expanding outside in the radial direction is formed in the leg portion 63*f*. The end member 63 is inserted into the open first end portion of the body 62 with the end surface 63*a* facing outside.

As illustrated in FIG. 12, each of the two claws 63*c*, 63*c* of the end member 63 is fitted into the hole 62*c* formed in the surrounding wall of the body 62. The end member 63 is rigidly attached to the body 62 by the fitting of the claws 63*c* into the holes 62*c*. As the claw 63*c* is displaceable within a length range of the hole 62*c* in the axis center C direction, the end member 63 is displaceable in the axis center C direction within the displaceable range of the claw 63*c* in the hole 62*c*.

As illustrated in FIG. 12, when the end member 63 is located in the outermost in the axis center C direction, the end surface 63*a* projects outside an end surface 62*b* of the flange 62*a* of the body 62 in the axis center C direction. Such a projection is shown by a measurement L. On the other hand, as illustrated in FIG. 13, when the end member 63 is disposed inside in the axis center C direction, the end surface 63*a* is withdrawn inside the end surface 62*b* of the flange 62*a* of the body 62 in the axis center C direction.

The end member 63 includes a concave portion 63*b* (one example of a concave portion) recessed from the end surface 63*a* toward the extending direction of the leg portion 63*f*. Even when the end member 63 is located in the outermost, the concave portion 63*b* is recessed from the end surface 63*a* of the body 62. Similar to the end surface 63*a*, the concave portion 63*b* has an approximate hexagonal contour as viewed in the axis center C direction. The concave portion 63*b* is a hexagonal cylinder space including the axis center C. An inner circumference surface 63*d* of the concave portion 63*b* is formed by a plane extending in the axis center C direction.

As illustrated in FIGS. 5, 8, the concave portion 63*b* rotatably engages with a convex portion 71 (one example of the support portion, one example of the convex portion) projecting from the end surface of the ribbon flange 70 attached to the support member 41. The concave portion 63*b* is supported by the convex portion 71 and the projection portion 65 is supported by the support hole 72. The shaft 60 is thereby rotatably supported by the support member 41. The projection portion 65 and the end member 63 are one example of the supported portion to be supported by the support portion of the support member 41.

As illustrated in FIG. 5, the side wall 41*b* in which the support hole 72 is formed has a portion upward and forward (forward F in FIG. 2) of the support hole 72. This portion is recessed outside in the axis center direction from a portion behind (direction opposite to forward F in FIG. 2) and below the support hole 72. The boundaries between the recessed portion and the non-recessed portion are steps 41*c*, 41*d*, respectively. The spacing between these two steps 41*c*, 41*d* narrows toward the support hole 72. When the steps 41*c*, 41*d* contact the support hole 72, the spacing between these two steps 41*c*, 41*d* has the almost same size as the diameter of the support hole 72.

Accordingly, when the projection portion 65 disposed between both steps 41*c*, 41*d* contact one of the steps 41*c*, 41*d*, the projection portion 65 is guided to the support hole 72 along the step 41*c*, 41*d*. The steps 41*c*, 41*d* therefore operate as guide portions that guide the projection portion 65 until the projection portion 65 engages with the support hole 72.

Similarly, the side wall 41*b* in which a support hole 74 is formed has a fan-shaped portion above the support hole 74 and a fan-shaped portion below the support hole 74. These fan shaped portions are recessed outside in the axis direction from a portion forward the support hole 74 and a portion behind the support hole 74. The boundaries of the recessed portion and the non-recessed portion above the support hole 74 are steps 41*e*, 41*f*, respectively. The boundaries between the recessed portion and the non-recessed portion below the support hole 74 are steps 41*g*, 41*h*, respectively.

The two steps 41*e*, 41*f* have therebetween a spacing that narrows toward the support hole 74. When the steps 41*e*, 41*f* are connected to the support hole 74, the spacing between the steps 41*e*, 41*f* has the almost same size as the diameter of the support hole 74. Accordingly, when the projection portion 55 of the shaft 50 disposed between both steps 41*e*, 41*f* contacts one of the steps 41*e*, 41*f*, the projection portion 55 is guided to the support hole 74 along the step 41*e*, 41*f*. The steps 41*e*, 41*f* therefore operate as guide portions that guide the projection portion 55 until the projection portion 55 engages with the support hole 74. In addition, the recessed portion is formed to have a depth relative to the non-recessed portion, which decreases toward the support hole 74.

The two steps 41*g*, 41*h* also has therebetween a spacing that narrows toward the support hole 74. When the steps 41*g*, 41*h* connect to the support hole 74, the spacing between the steps 41*g*, 41*h* has the almost same size as the diameter of the support hole 74. Accordingly, when the projection portion 55 of the shaft 50 disposed between both steps 41*g*, 41*h* contacts one of the steps 41*g*, 41*h*, the projection portion 55 is guided to the support hole 74 along the step 41*g*, 41*h*. The steps 41*g*, 41*h* therefore operate as guide portions that guide the projection portion 55 until the projection portion 55 engages with the support hole 74. In addition, the recessed portion is formed to have a depth relative to the non-recessed portion, which decreases toward the support hole 74.

The convex portion 71 of the ribbon flange 70 and the support hole 72 are disposed to face each other. The ribbon flange 70 is rotatably connected to the clutch mechanism 61. As illustrated in FIGS. 4, 8, the convex portion 71 includes, in a tip portion thereof in the axis center C direction, a portion 71*d* having a hexagonal truncated pyramid liked shape extending in the axis center C direction. The convex portion 71 includes, in a base portion thereof which is close to the projected end surface of the ribbon flange 70, a neck 71*c* having a measurement (diameter) smaller than that of the base portion of the portion 71*d* having the truncated pyramid liked shape.

The concave portion 63*b* of the shaft 60 that engages with the convex portion 71 is a hexagonal cylinder space. This hexagonal cylinder corresponds to the number of corners of the truncated pyramid liked portion 71*d* formed in the tip portion of the convex portion 71. When the convex portion 71 has a pentagonal truncated pyramid liked shape, the concave portion 63*b* has a pentagonal cylinder shape. When the convex portion 71 has a heptangular truncated pyramid liked shape, the concave portion 63*b* has a heptangular cylinder shape. When the convex portion 71 has an octagonal truncated pyramid liked shape, the concave portion 63*b* has an octagonal cylinder shape.

The coil spring 64 that extends and contracts in the axis center C direction is disposed between the end member 63 and the body 62 with the coil spring 64 compressed to be shorter than a natural length. An elastic force in the axis center C direction of the coil spring 64 therefore acts on the end member 63, and the end member 63 is pressed outside the first end portion of the body 62. At this moment, the claw 63*c* of the end member 63 engages with the edge of the hole 62*c* of the body 62, which is close to the flange 62*a*, and the end member 63 is disposed in the outermost in the axis center C direction, as illustrated in FIG. 12.

The coil spring 64 can be further compressed in the axis center C direction. When the end member 63 is pressed inside in the axis center C direction by a load, the end member 63 elastically deforms the coil spring 64 so that the end member 63 is displaced inside in the axis center C direction within the displaceable range of the claw 63*c* in the hole 62*c*, as illustrated in FIG. 13.

As illustrated in FIGS. 10 to 13, the feeding shaft 50 has the same configuration as the winding shaft 60, and includes a body 52, an end member 53, and a coil spring 54. The body 52 is the same as the body 62. The end member 53 is the same as the end member 63. The coil spring 54 is the same as the coil spring 64.

A projection portion 55 formed in a second end portion of the body 52 rotatably engages with the support hole 74 (one example of the support portion) formed in the support member 41. A concave portion 53*b* formed in the end member 53 rotatably engages with a convex portion 73 (one example of the support portion, one example of the convex portion) projecting from the end surface of the ribbon flange 75 attached to the support member 41. The concave portion 53*b* is supported by the convex portion 73 and the projection portion 55 is supported by the support hole 74. The shaft 50 is thereby rotatably supported by the support member 41. The projection portion 55 and the end member 53 are one example of the supported portion to be supported by the support portions of the support member 41.

The convex portion 73 of the ribbon flange 75 and the support hole 74 are disposed to face each other. The ribbon flange 75 is rotatably connected to the clutch mechanism 51. As illustrated in FIGS. 4, 9, the convex portion 73 includes, in the tip portion thereof in the axis center C direction, a portion 73*d* having the hexagonal truncated pyramid liked shape extending in the axis center C direction. The convex portion 73 includes, in a base portion thereof which is close to the projected end surface of the ribbon flange 75, a neck

73*c* having a measurement (diameter) smaller than that of the base portion of the portion 73*d* having the truncated pyramid liked shape.

The concave portion 53*b* of the shaft 50 that engages with the convex portion 73 is a hexagonal cylinder space. The hexagonal cylinder corresponds to the number of corners of the truncated pyramid liked portion 73*d* formed in the tip portion of the convex portion 73. When the convex portion 73 has a pentagonal truncated pyramid liked shape, the concave portion 53*b* has a pentagonal cylinder shape. When the convex portion 73 has a heptangular truncated pyramid liked shape, the concave portion 53*b* has a heptangular cylinder shape. When the convex portion 73 has an octagonal truncated pyramid liked shape, the concave portion 53*b* has an octagonal cylinder shape.

Although, the convex portion 71 and the support hole 72 that constitute the support portions are provided in a single support member 41, the support member 41 may be formed as facing two members, and the convex portion 71 and the support hole 72 may be provided in the two support members 41, respectively. The similar configuration may be adopted by the convex portion 73 and the support hole 74.

(Operation) According to the ink ribbon support mechanism and the printer 100 including the same of the present embodiment configured as described above, the convex portion 71 of the ribbon flange 70 provided in the support member 41 is fitted into the concave portion 63*b* of the end member 63, and the projection portion 65 of the end member 63 is fitted into the support hole 72 of the support member 41 as illustrated in FIG. 8. The winding shaft 60 is thereby disposed between the side walls 41*a*, 41*b* to be supported by the support member 41. When the shaft 60 is supported by the support member 41, the end member 63 presses the coil spring 64 so that the coil spring 64 is compressed.

The end member 63 is thereby withdrawn inside in the axis center direction from the end surface 62*b* of the flange 62*a* of the body 62. Accordingly, as the end member 63 can be withdrawn in the axis center direction when the shaft is attached, the measurement of the shaft 60 with the shaft 60 supported can be reduced to be smaller than that of the shaft in which the end member 63 cannot be withdrawn inside in the axis center direction. This configuration is also adopted by the feeding shaft 50 illustrated in FIG. 9.

In the ink ribbon support mechanism and the printer 100 including the same of the present embodiment, when the shaft 60 is supported by the support member 41, at first, the convex portion 71 of the ribbon flange 70 is fitted into the concave portion 63*b* of the end member 63. Here, the printer 100 has an interval between the facing side walls 41*a*, 41*b* slightly longer than the length of the shaft 60. Such a configuration does not allow the front face of the concave portion 63*b* to face the front face of the convex portion 71 (the direction toward support hole 72) (the axis center of the shaft 60 cannot be aligned with straight line connecting convex portion 71 and support hole 72) upon engaging the concave portion 63*b* with the convex portion 71.

Figure 14:
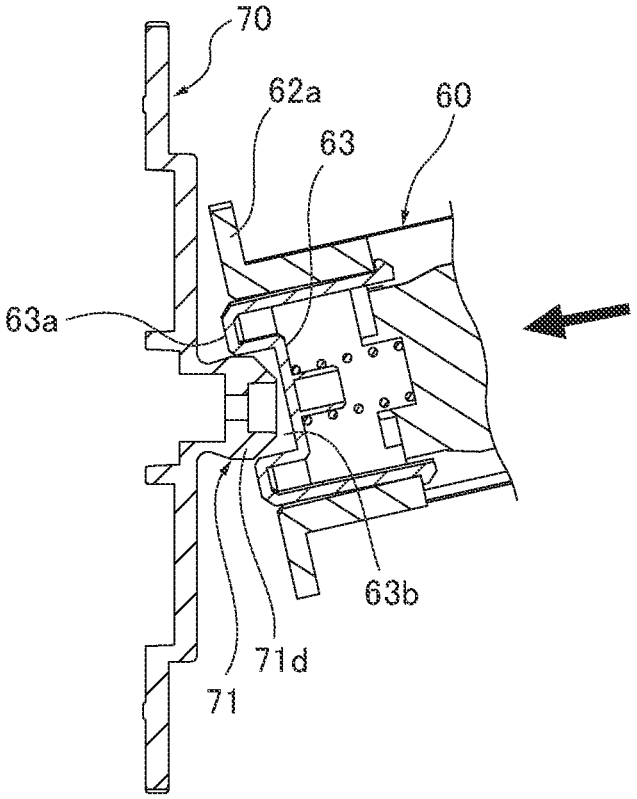
FIG. 14 is a cross-sectional view of a main portion illustrating a process (part 1) of supporting a concave portion of the winding shaft by a convex portion of a ribbon flange.
Figure 15:
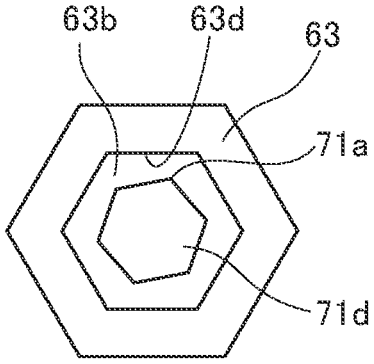
FIG. 15 is a view schematically illustrating a size relationship of outer contours of the concave portion and the convex portion illustrated in FIG. 14.

In this case, as illustrated in FIG. 14, the concave portion 63*b* is directed to face the convex portion 71 with the shaft 60 inclined upward or forward (the projection portion 65 is located upward or forward of the support hole 72), and the concave portion 63*b* is moved to be closer to the convex portion 71. The convex portion 71 is thereby inserted into the concave portion 63*b*. In this case, in the beginning of the insertion, only the tip portion of the convex portion 71 is inserted into the concave portion 63*b*. As the tip portion of the convex portion 71 is the portion 71*d* having the hexagonal truncated pyramid liked shape, the hexagonal cross-section at the tapered leading end of the convex portion 71 is smaller than the hexagonal cross-section of the concave portion 63*b* having the hexagonal cylinder space, as the size relationship illustrated in FIG. 15. With this size relationship, a ridge 71*a* of the hexagonal truncated pyramid liked portion 71*d* does not contact an inner circumference surface 63*d* of the concave portion 63*b* when the centers of the respective hexagons are aligned.

However, it is not always true that the centers of the hexagons are aligned when the convex portion 71 is actually inserted into the concave portion 63*b*, and a part of the ridge 71*a* of the hexagonal truncated pyramid liked portion 71*d* may contact a part of the inner circumference surface 63*d* of the concave portion 63*b*.

Figure 16:
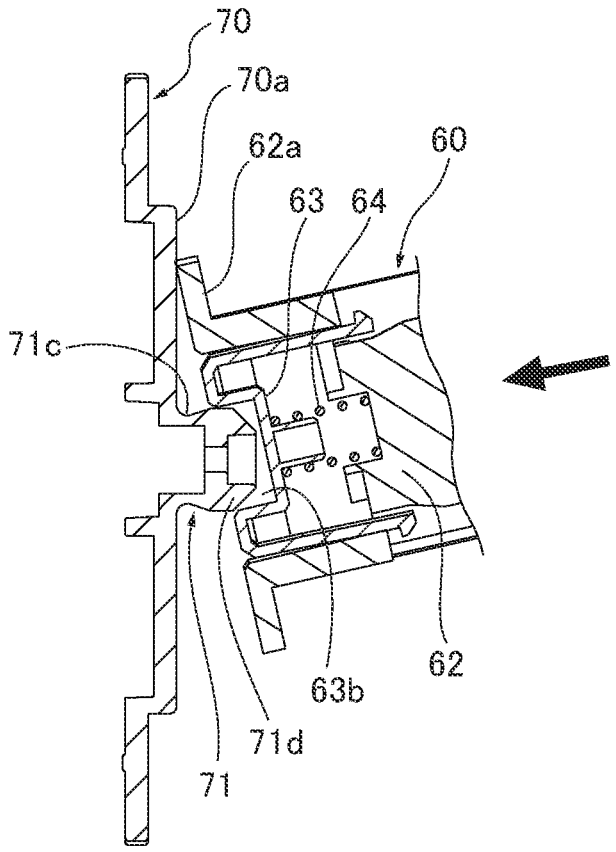
FIG. 16 is a cross-sectional view of a main portion illustrating a process (part 2) of supporting the concave portion of the winding shaft by the convex portion of the ribbon flange.

As illustrated in FIG. 16, in accordance with an increase in the insertion amount of the convex portion 71 into the concave portion 63*b*, the ridge 71*a* of the hexagonal truncated pyramid liked portion 71*d* starts contacting the inner circumference surface 63*d* of the concave portion 63*b*. A part of the ridge 71*a* that contacts the inner circumference surface 63*d* receives a reaction force (normal reaction) from the inner circumference surface 63*d*. At this time, the convex portion 71 receives a torque that rotates about the center by the normal reaction received from the inner circumference surface 63*d* unless the angles between the two slopes 71*b*, 71*b* across the ridge 71*a* and the inner circumference surfaces 63*d* are equal to each other. This torque rotates the convex portion 71 such that the ridge 71*a* is aligned with a corner portion 63*e* as a borderline of the two inner circumference surfaces 63*d*, 63*d* next to each other.

Upon exchanging the ink ribbon 2, the cover 20 is opened. As the ribbon flange 70 is rotatable, the ribbon flange 70 rotates by the torque, and the ridge 71*a* of the hexagonal truncated pyramid liked portion 71*d* is aligned with the corner portion 63*e* of the concave portion 63*b* to be fitted. The shaft 60 thereby rotates integrally with the ribbon flange 70. In accordance with an increase in the insertion amount of the convex portion 71 into the concave portion 63*b*, when the convex portion 71 contacts the concave portion 63*b*, the coil spring 64 is compressed, and the end member 63 is pressed inside the body 62 until the flange 62*a* contacts the end surface 70*a* of the ribbon flange 70.

Figure 17A:
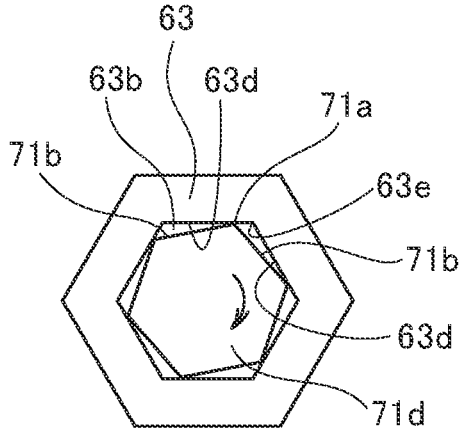
FIG. 17A is a view schematically illustrating a size relationship of outer contours of the concave portion and the convex portion illustrated in FIG. 16.
Figure 17B:
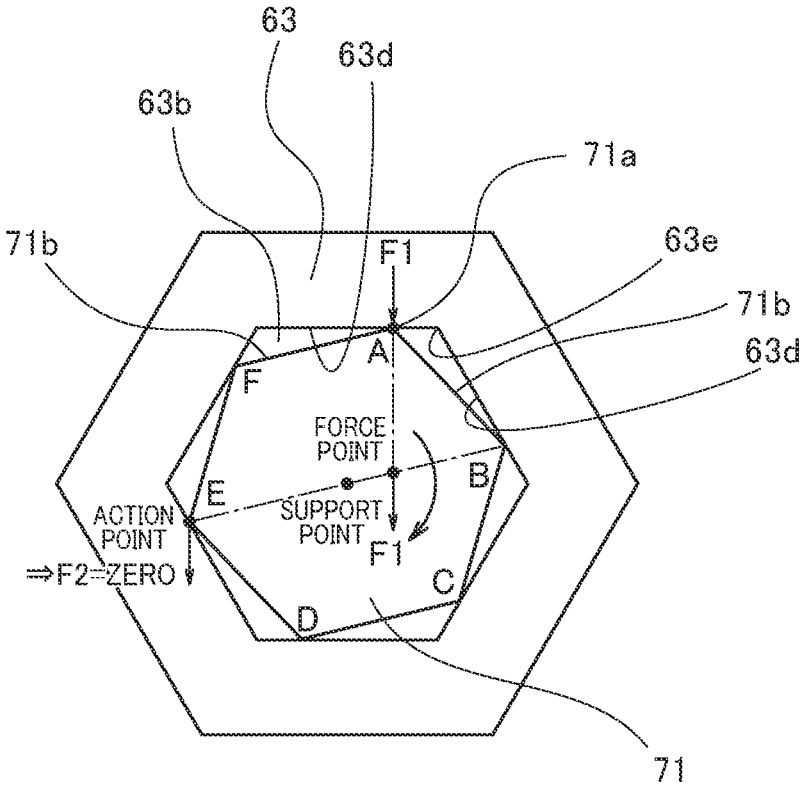
FIG. 17B is a view describing a rotation torque generated on the convex portion of FIG. 17A by a load acting on the convex portion.

More specifically, the following operation is performed. The ribbon flange 70 including the convex portion 71 is rotatably and coaxially attached to the shaft 60. As illustrated in FIG. 17B, when a point at which a virtual line (broken line) passing through the rotation center of the convex portion 71 intersects the vertical direction of the inner circumference surface 63*d* represents a force point and the center of the convex portion 71 represent a support point, an end portion opposite to the force point across the support point of the virtual line represents an action point.

The rotation torque about the support point is generated at an apex A of the convex portion 71 corresponding to the ridge 71*a* in accordance with a distance between the support point and the force point and the magnitude of the reaction force (normal reaction) F1 that the convex portion 71 receives from the inner circumference surface 63*d*. The load acting on the action point is a frictional force only between the inner circumference surface 63*d* and the action point, which may be substantially ignored. At this time, the rotation torque about the support point is generated, similar to the above-described apex A, at the respective apexes B, C, D, E, F of the convex portion 71 corresponding to other ridges 71*a*. When the concave portion 63*b* engages with the convex portion 71, the centers of both portions are generally misaligned. The rotation torque is thus generated at an apex that firstly contacts the inner circumference surface 63*d* among the apexes A to F.

Figure 18:
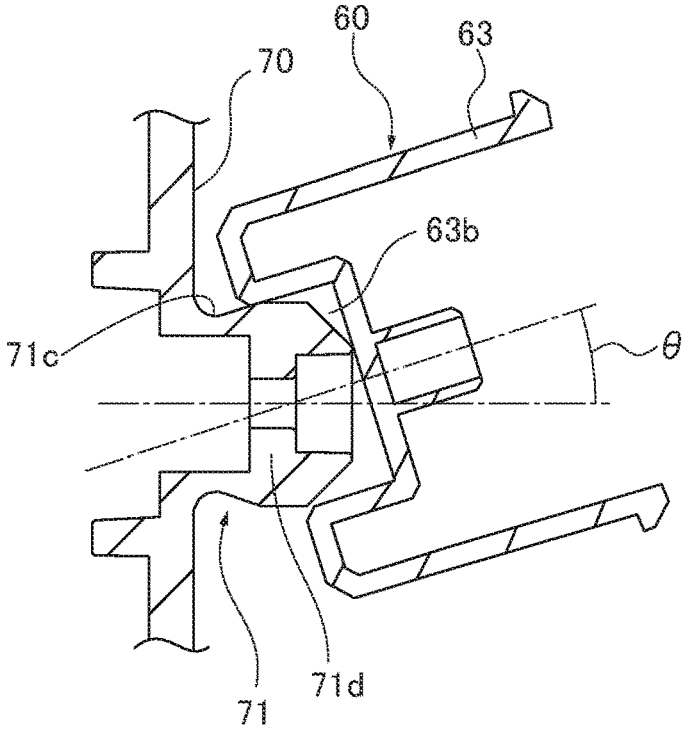
FIG. 18 is a cross-sectional view of a main portion illustrating a state in which an inner circumference surface of the concave portion enters a neck of the convex portion.

As the convex portion 71 includes, in the base portion thereof, the neck, the tip portion of the inner circumference surface 63*d* of the concave portion 63*b* can enter the neck 71*c* without reducing the inclination angle θ of the shaft 60, as illustrated in FIG. 18, in accordance with an increase in the insertion amount of the convex portion 71 into the concave portion 63*b* with the shaft 60 inclined.

Figure 19:
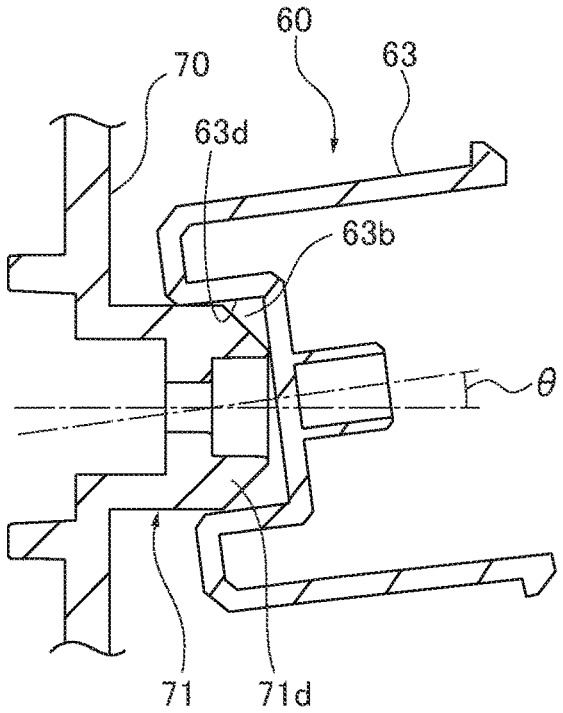
FIG. 19 is a cross-sectional view of a main portion illustrating a comparison of inclination of a shaft when the neck is not formed in the convex portion with respect to the inclination of the shaft when the neck is formed in the convex portion (FIG. 18).

As illustrated in FIG. 19, when the neck 71*c* is not formed, it is necessary to reduce the inclination angle θ of the shaft 60, otherwise the inner circumference surface 63*d* of the concave portion 63*b* interferes with the circumference surface of the convex portion 71. When the inclination angle θ is reduced, it is necessary to increase the size of the printer 100 in the width direction.

On the other hand, in the ink ribbon support mechanism and the printer 100 including the same of the present embodiment, as the neck 71*c* is formed in the base portion of the convex portion 71, the size of the printer 100 in the width direction can be reduced to be smaller than that of the printer 100 in which the neck 71*c* is not formed.

Figure 20:
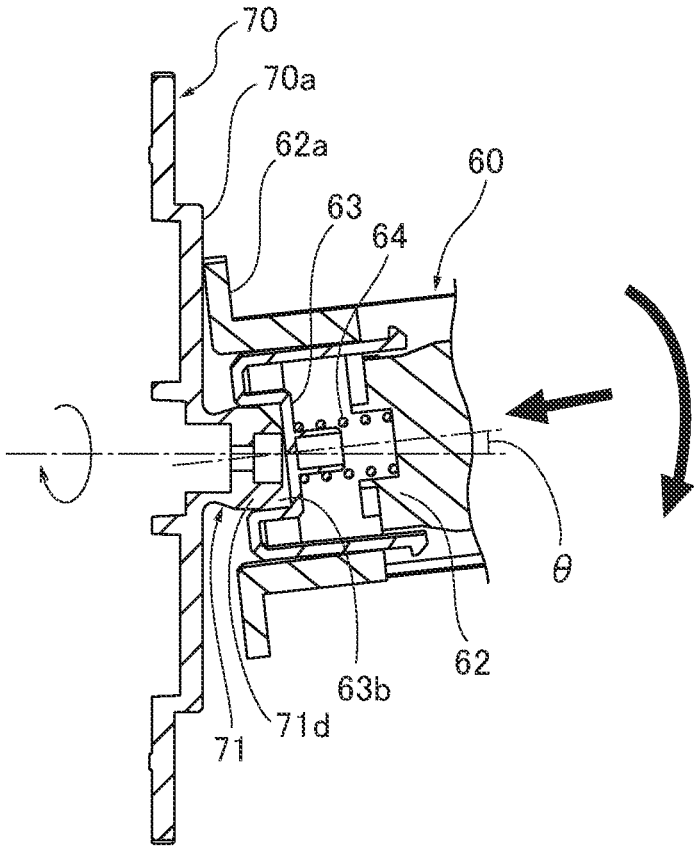
FIG. 20 is a cross-sectional view of a main portion illustrating a process (part 3) of supporting the concave portion of the winding shaft by the convex portion of the ribbon flange.

When the flange 62*a* contacts the end surface 70*a* of the ribbon flange 70 upon a further increase in the insertion amount of the convex portion 71 into the concave portion 63*b*, as illustrated in FIG. 20, the concave portion 63*b* is further pressed to the convex portion 71 while reducing the inclination angle θ of the shaft 60 to withdraw the end member 63 inside the body 62. At this point, the projection portion 65 of the shaft 60 provided in the second end portion of the shaft 60 is guided toward the support hole 72 by the step 41*c* or the step 41*d* as the guide portion.

Figure 21:
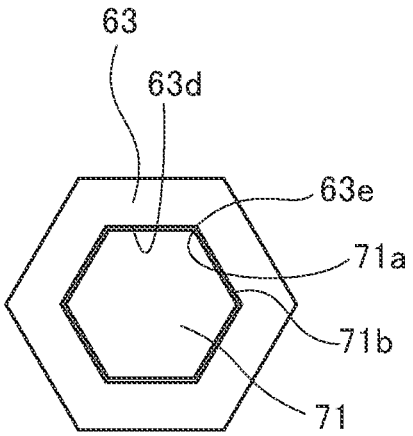
FIG. 21 is a view schematically illustrating a size relationship of outer contours of the concave portion and the convex portion when the winding shaft is supported by a support member 41.

When the shaft 60 is aligned with the axis line connecting the convex portion 71 and the support hole 72 (inclination angle θ=0 (degree)), the projection portion 65 is fitted into the support hole 72, and the shaft 60 is supported by the convex portion 71 and the support hole 72. At this time, as illustrated in FIG. 21, when the ridge 71*a* of the convex portion 71 is fitted into the corner portion 63*e* of the concave portion 63*b*, the shaft 60 becomes rotatable integrally with the ribbon flange 70.

The movement until the feeding shaft 50 is supported by the convex portion 73 and the support hole 74 is the same as the movement until the above-described winding shaft 60 is supported by the convex portion 71 and the support hole 72. The feeding shaft 50 supported by the convex portion 73 and the support hole 74 is also the same as the winding shaft 60 supported by the convex portion 71 and the support hole 72. The description for the feeding shaft 50 is thus omitted. As the feeding shaft 50 may be attached from the lower side of the support hole 74 in addition to the upper side of the support hole 74, the steps 41*g*, 41*h* that guide the feeding shaft 50 from the lower side are formed in addition to the steps 41*e*, 41*f* that guide the feeding shaft 50 from the upper side.

As described above, in the ink ribbon support mechanism and the printer 100 including the same of the present embodiment, the convex portion 71, 73 is formed into the truncated pyramid liked shape, and the concave portion 63*b*, 53*b* is formed into the square column space. Accordingly, even though a user engages the concave portion 63*b*, 53*b* with the convex portion 71, 73 at a random angular positional relationship without making a user conscious of the position of the convex portion 71, 73 in the rotation direction and the position of the concave portion 63*b*, 53*b* in the rotation direction, the torque acts on the convex portion 71, 73 in accordance with an increase in the insertion amount of the convex portion 71, 73 into the concave portion 63*b*, 53*b*, so that the convex portion 71, 73 rotates relative to the concave portion 63*b*, 53*b*. Accordingly, it becomes possible to prevent or control the problem in the prior art in which the ribs of the convex portion cannot be fitted into the concave portion because the rib of the convex portion contacts the projecting portion of the concave portion.

In the ink ribbon support mechanism and the printer 100 including the same of the present embodiment, as the number of corners (the number of the ridges 71*a*) of the truncated pyramid liked convex portion 71, 73 is selected from five to eight, the rotation position of the convex portion 71, 73 on which the rotation torque acts is hardly displaced when the convex portion 71, 73 is fitted into the concave portion 63*b*, 53*b*. On the other hand, when the number of corners of the truncated pyramid liked convex portion 71, 73 is four or less, the convex portion 71, 73 contacts the circumference of the concave portion 63*b*, 53*b* due to the displaced rotation position, which disturbs the convex portion 71, 73 from being fitted into the concave portion 63*b*, 53*b*. As a result, the area in which the convex portion 71, 73 faces the concave portion 63*b*, 53*b* is expanded, and the range of the displaced rotation position which disturbs the generation of the rotation torque is thus expanded.

Further, when the number of corners of the truncated pyramid liked convex portions 71, 73 is nine or more, the contour of the truncated pyramid liked convex portion 71, 73 becomes almost circular. Such a configuration hardly generates the rotation torque even though the convex portion 71, 73 is fitted into the concave portion 63*b*, 53*b*, and easily removes or rounds the corners in accordance with an increase in the number of fittings.

In the ink ribbon support mechanism and the printer 100 including the same of the present embodiment, the shaft 60, 50 includes the end member 63, 53 that is withdrawn in the axis center direction, and the coil spring 64, 54. The withdrawn amount can be thereby increased to be larger than the configuration in which the end member and the coil spring are provided in the support member 41.

When the shaft 60, 50 includes the coil spring 64, 54, in the process of fitting the convex portion 71, 73 into the concave portion 63*b*, 53*b*, the rotation positions of the concave portion 63*b*, 53*b* and the convex portion 71, 73 are aligned easier than the configuration in which the coil spring 64, 54 is not provided. More specifically, as illustrated in FIG. 22, the convex portion 71 has a measurement L2 (measurement between facing ridges 71*a*, 71*a*) along the diagonal line passing through the center of the convex portion 71 is larger than an interval L1 of the facing two inner circumference surfaces 63*d*, 63*d* of the concave portion 63*b*.

Figure 22:
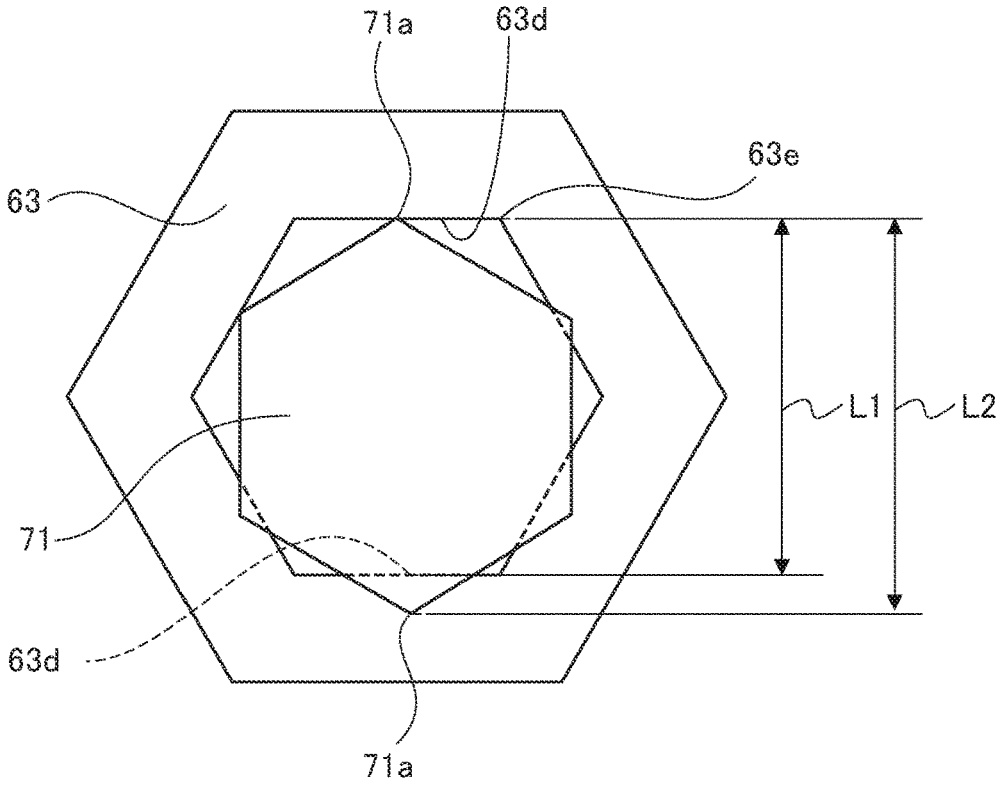
FIG. 22 is a view schematically illustrating a state in which the concave portion engages with the convex portion with the shaft inclined, and illustrating the convex portion and the concave portion as viewed in a front direction of the convex portion.

As illustrated in FIG. 22, when the rotation angle position of the corner portion 63*e* of the concave portion 63*b* is displaced relative to the ridge 71*a* of the convex portion 71 at about 30 (degrees), the upper ridge 71*a* of the convex portion 71 contacts the center of the upper inner circumference surface 63*d* near the open end of the concave portion 63*b*. At this point, the remaining five ridges 71*a* of the convex portion 71 contact the centers of the inner circumference surfaces 63*d*, respectively, near the open end of the concave portion 63*b*, as illustrated in FIG. 22.

Even though the rotation angle position is slightly displaced in the rotation direction from 30 (degrees) between the concave portion 63*b* and the convex portion 71, it is not always true that the convex portion 71 rotates by simply pressing the concave portion 63*b* to the convex portion 71.

This is because that the frictional force between the concave portion 63*b* and the convex portion 71 is larger than the torque in the rotation direction generated to the convex portion 71 due to the slight displacement of the rotation direction.

Figure 23:
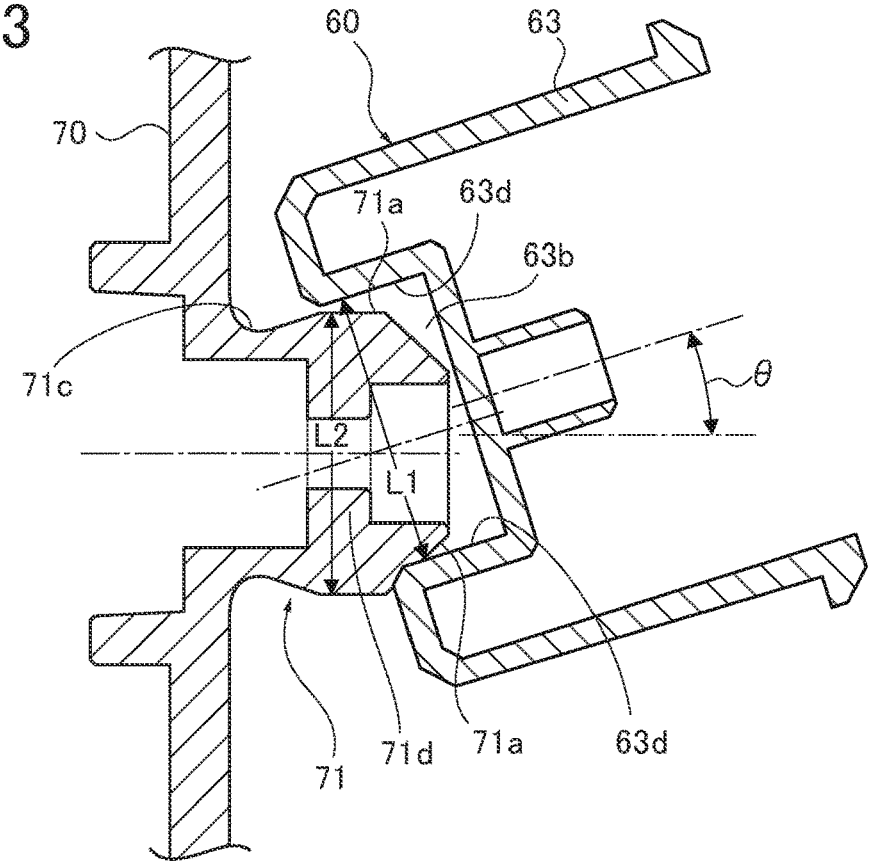
FIG. 23 is a longitudinal cross-sectional view illustrated in FIG. 22.

On the other hand, when the shaft 60 includes the coil spring 64, the coil spring 64 can be compressed from the state illustrated in FIGS. 22, 23. The projection portion 65 provided in the second end portion can be guided to the support hole 72 along the steps 41*c*, 41*d* constituting the guide portions of the side wall 41*b*. As described above, when the shaft 60 is horizontally maintained, the concave portion 63*b* presses the convex portion 71 in the horizontal direction, as illustrated in FIGS. 24, 25.

Figure 24:
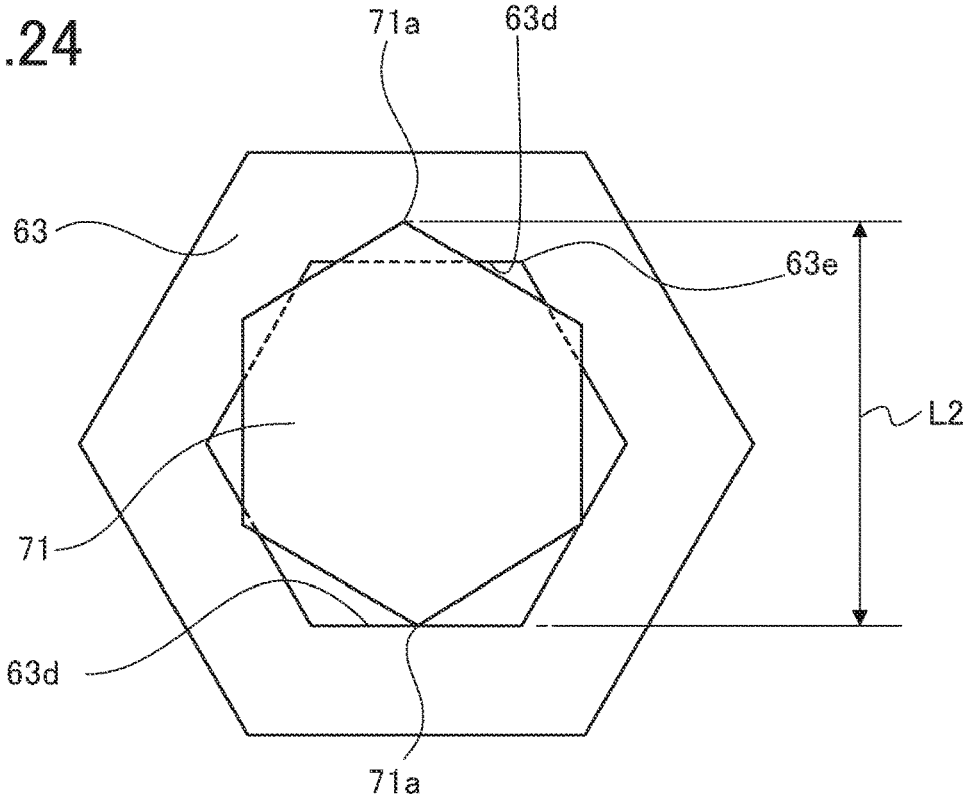
FIG. 24 is a schematic view illustrating a state in which the concave portion is engaged with the convex portion with the shaft horizontally maintained, and illustrating the convex portion and the concave portion as viewed in the front direction of the convex portion.
Figure 25:
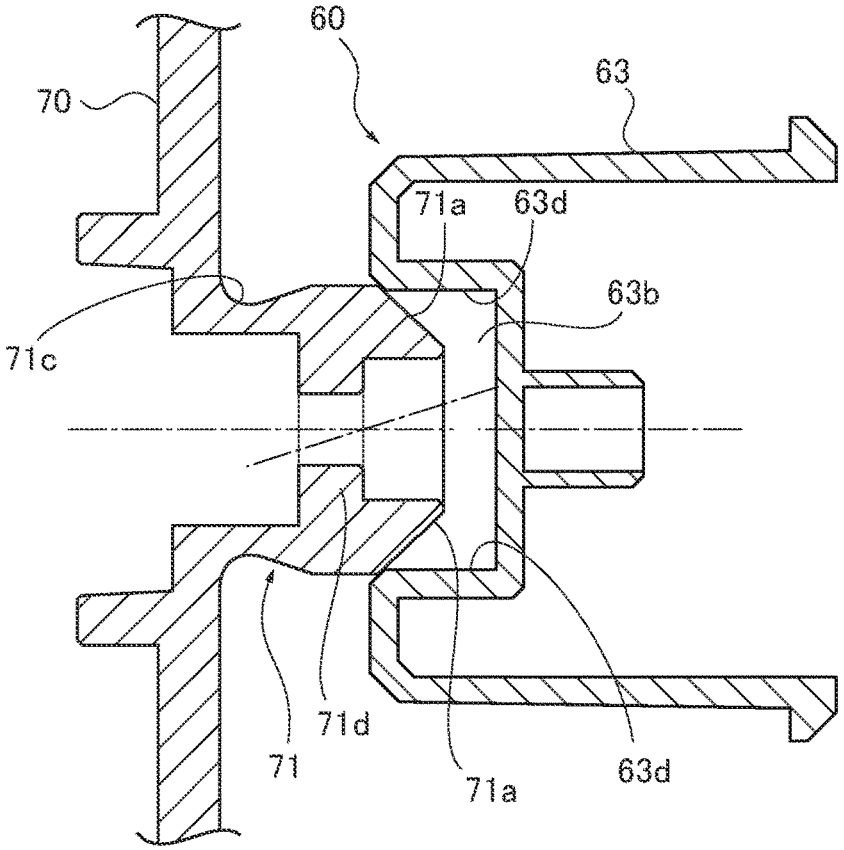
FIG. 25 is a longitudinal cross-sectional view of the state illustrated in FIG. 24.

With the state illustrated in FIGS. 24, 25, as the concave portion 63*b* and the convex portion 71 are directed in the axis direction, the concave portion 63*b* maximumly presses each portion near each ridge 71*a* of the convex portion 71. Accordingly, even though the rotation directions of the concave portion 63*b* and the convex portion 71 are slightly displaced, the rotation torque is approximately equally generated at six positions. The convex portion 71 thereby rotates easier than the state illustrated in FIGS. 22, 23.

From the state illustrated in FIGS. 22, 23 to the state illustrated in FIG. 24, 25, when an impact is applied to the shaft 60, the shaft 60 slightly rotates or the position at which the concave portion 63*b* contacts the convex portion 71 is displaced. The positions of the concave portion 63*b* and the convex portion 71 are thereby displaced, so that the above described rotation torque is easily generated.

When the rotation angle position of the corner portion 63*e* of the concave portion 63*b* is displaced to the ridge 71*a* of the convex portion 71, as illustrated in FIG. 24, the spring force by which the concave portion 63*b* presses the convex portion 71 with the coil spring 64 compressed acts, and the projection portion 65 is fitted into the support hole 72 to be rotatable. These contribute to generate the rotation torque between the concave portion 63*b* and the convex portion 71.

In order to move the shaft 60 from the state illustrated in FIGS. 22, 23 to the state illustrated in FIGS. 24, 25, the projection portion 65 of the shaft 60 may be withdrawn. More specifically, the projection portion 65 may be formed separately from the shaft 60, and a spring similar to the coil spring 64 may be provided inside the projection portion 65.

Further, the withdrawing structure may be provided in the support hole 72 without providing the withdrawing structure in the shaft 60. In this case, for example, a bearing member into which the projection portion 65 is fitted is formed inside the support hole 72 separately from the side wall 41*b*. A coil spring that withdraws the bearing member toward the side wall 41*b* is provided between the bearing member and the side wall 41*b*. This configuration differs in the method of attaching the shaft 60 from the configuration illustrated in FIG. 14, for example. The projection portion 65 of the shaft 60 is firstly fitted into the bearing member.

Then, the bearing member is pressed to the side wall 41*b* with the concave portion 63 of the shaft 60 directed obliquely upward. The concave portion 63*b* of the shaft 60 is then gradually moved to be closer to the horizontal direction, and engages with the convex portion 71 of the ribbon flange 70. When the shaft 60 is horizontally maintained, the concave portion 63*b* of the shaft 60 is pressed to the convex portion 71 of the ribbon flange 70 by the coil spring of the bearing member.

The rotation torque that aligns the rotation angle position with the concave portion 63*b* without making a user conscious can be thereby generated on the ribbon flange 70 even though the rotation position of the convex portion 71 is displaced to the concave portion 63*b* of the shaft 60. This operation is similar to the operation when the above-described shaft 60 is horizontally maintained.

The description for the operations of the shaft 60, the convex portion 71 of the ribbon flange 70, the support hole 72, and the steps 41*c*, 41*d* as the guide portions are similar to the operations of the shaft 50, the convex portion 73 of the ribbon flange 75, the support hole 74, and the steps 41*e*, 41*f*, 41*g*, 41*h* as the guide portions.

As one of the supported portions provided on both end portions of the shaft 50, 60 is the projection portion 55, 65 in the ink ribbon support mechanism and the printer 100 including the same of the present embodiment, the support portion formed in the support member 41 that supports the shaft 50, 60 can be formed as the hole (support hole 72, 74) in which the projection portion 55, 65 is fitted. Accordingly, the support member 41 can be simply formed.

In the ink ribbon support mechanism and the printer 100 including the same, one of the supported portions provided on both end portions of the shaft 50, 60 may not be the projection portion 55, 65. Both of the supported portions provided on both end portions may be projection portions, respectively.

In the ink ribbon support mechanism and the printer 100 including the same, the end member 53, 63 that withdraws in the axis center direction and the coil spring 54, 64 may be provided in the support member 41 or the ribbon flange 70, 75.

In the ink ribbon support mechanism and the printer 100 including the same, as the steps 41*c*, 41*d*, 41*e*, 41*f*, 41*g*, 41*h* as the guide portions are formed in the side wall 41*b* of the support member 41, the projection portion 65, 55 of the shaft 60, 50 can be simply guided to the support hole 72, 74. The printer 100 of the present embodiment is not limited to the one in which the steps 41*c*, 41*d*, 41*e*, 41*f*, 41*g*, 41*h* are formed.

When the shaft 60 is aligned with the axis line connecting the convex portion 71 and the support hole 72 (inclination angle θ=0 (degree)), the projection portion 65 is fitted into the support hole 72. The shaft 60 is thereby supported by the convex portion 71 and the support hole 72. As illustrated in FIG. 21, when the ridge 71*a* of the convex portion 71 is fitted into the corner portion 63*e* of the concave portion 63*b*, the shaft 60 becomes rotatable integrally with the ribbon flange 70.

What is claimed is:

1. An ink ribbon support mechanism, comprising:

one support member or a plurality of support members; and a ribbon shaft that supports an ink ribbon, wherein two support portions are provided in the one support member or each of the plurality of support members to face each other, or the one support portion is provided in each of the plurality of support members to face each other, the ribbon shaft includes, in both end portions thereof, supported portions that engage with the two support portions, respectively, one of the two support portions is rotatable, one of the rotatable support portion and the supported portion that engages with the rotatable support portion includes a convex portion projecting from an end surface, and another of the rotatable support portion and the supported portion that engages with the rotatable support portion includes a concave portion that is recessed from the end surface and engages with the convex portion, the convex portion includes a portion having any one of pentagonal to octagonal truncated pyramid liked shapes extending in an axis direction, the concave portion has a polygonal liked shape corresponding to the number of corners of the portion having the truncated pyramid liked shape, and at least one of the rotatable support portion and the ribbon shaft includes an elastic member that elastically displaces at least one part of the two support portions and the two supported portions in a withdrawing direction.

2. The ink ribbon support mechanism according to claim 1, wherein the convex portion includes a neck in a base portion of the convex portion which is close to the projecting end surface.

3. The ink ribbon support mechanism according to claim 1, wherein the elastic member is provided in the ribbon shaft.

4. The ink ribbon support mechanism according to claim 1, wherein the elastic member is provided in a first end portion of the ribbon shaft only.

5. The ink ribbon support mechanism according to claim 4, wherein the supported portion of the ribbon shaft in a second end portion opposite to the first end portion provided with the elastic member is a projection portion projecting in the axis direction, and the support portion that engages with the projection portion is a concave portion or a hole into which the projection portion is fitted.

6. The ink ribbon support mechanism according to claim 5, wherein the support member is provided with a guide portion that guides the projection portion until the projection portion engages with the concave portion or the hole.

7. The ink ribbon support mechanism according to claim 1, wherein the elastic member is provided in the support member.

8. A printer comprising the ink ribbon support mechanism according to claim 1.

* * * * *